US008897681B2

(12) United States Patent
Hirota et al.

(10) Patent No.: US 8,897,681 B2
(45) Date of Patent: Nov. 25, 2014

(54) DEVELOPING DEVICE, IMAGE FORMING APPARATUS, AND IMAGE FORMING METHOD

(75) Inventors: Tetsuro Hirota, Kanagawa (JP); Hideki Kosugi, Kanagawa (JP); Masaaki Yamada, Tokyo (JP); Atsushi Kurokawa, Kanagawa (JP); Hideyasu Seki, Tokyo (JP); Yasuyuki Ishii, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 561 days.

(21) Appl. No.: 13/222,344

(22) Filed: Aug. 31, 2011

(65) Prior Publication Data

US 2012/0063797 A1 Mar. 15, 2012

(30) Foreign Application Priority Data

Sep. 10, 2010 (JP) ..... 2010-202865

(51) Int. Cl.
*G03G 15/08* (2006.01)
*G03G 15/06* (2006.01)

(52) U.S. Cl.
CPC .... *G03G 15/0818* (2013.01); *G03G 2215/0651* (2013.01)
USPC ..... 399/284; 399/55; 399/285

(58) Field of Classification Search
CPC ..... G03G 13/095; G03G 15/065; G03G 2215/0619; G03G 2215/062
USPC ..... 399/55, 284, 285
See application file for complete search history.

(56) References Cited

U.S. PATENT DOCUMENTS

| | | | |
|---|---|---|---|
| 7,526,238 | B2 | 4/2009 | Yamada et al. |
| 7,702,265 | B2 | 4/2010 | Kosugi et al. |
| 2009/0022523 | A1 | 1/2009 | Kadota et al. |
| 2009/0035025 | A1 | 2/2009 | Ishii et al. |
| 2009/0067889 | A1 | 3/2009 | Nakagawa et al. |

FOREIGN PATENT DOCUMENTS

| | | | |
|---|---|---|---|
| JP | 7-287620 | A | 10/1995 |
| JP | 8-6388 | A | 1/1996 |
| JP | 2008-8929 | | 1/2008 |
| JP | 2009-36929 | A | 2/2009 |
| JP | 2010-208238 | | 9/2010 |

OTHER PUBLICATIONS

Office Action issued Feb. 14, 2014 in Japanese Patent Application No. 2010-202865.

*Primary Examiner* — David Gray
*Assistant Examiner* — Erika J Villaluna
(74) *Attorney, Agent, or Firm* — Oblon, Spivak, McClelland, Maier & Neustadt, L.L.P.

(57) ABSTRACT

An image forming apparatus includes a latent image carrier to carry a latent image, a developing device having a toner carrier with first and second electrodes to develop the latent image by transferring the toner to a developing region between the toner carrier and the latent image carrier while causing the toner to hop between the first and second electrodes and attaching the hopping toner to the latent image, a pulsed power supply to output a first periodic pulse voltage having a mean potential the same as a normal toner charge and a second periodic pulse voltage, a smoothing circuit to make the first periodic pulse voltage smooth to generate a direct voltage, and a toner layer thickness regulator member to regulate, on receiving the direct voltage, a thickness of the toner layer in a region between a toner supply position at which toner is supplied and the developing region.

15 Claims, 15 Drawing Sheets

DEVELOPING DEVICE, IMAGE FORMING APPARATUS, AND IMAGE FORMING METHOD

BACKGROUND OF THE INVENTION

1. Field of the Invention

The disclosures herein relate to a developing device, an image forming apparatus and an image forming method for developing an image in a hopping developing system by attaching a toner hopping on a surface of a toner carrier to a latent image formed on a latent image carrier.

2. Description of the Related Art

Japanese Patent Application Publication No. 2008-008929 (hereinafter called "Patent Document 1") discloses one example of an image forming apparatus configured to develop an image in a hopping developing system. The disclosed image forming apparatus includes a developing device that includes a toner carrier roller formed of a rotatable cylindrical base and two or more electrodes adjacently arranged at a predetermined pitch along a periphery of the cylindrical base. In the image forming apparatus, a first periodic pulse voltage and a second periodic pulse voltage respective phases of which are shifted from each other are applied to adjacent electrodes. When such first and second periodic pulse voltages having mutually shifted phases are applied to the adjacent electrodes, alternating fields are formed between the adjacent electrodes, which cause toner on a surface of a toner carrier roller to reciprocate between the adjacent electrodes while exhibiting a hopping behavior. The toner is thus carried to a developing region formed between the toner carrier roller and the photoreceptor where the toner carrier faces a photoreceptor with a rotational movement of the toner carrier roller while reciprocally hopping between the adjacent electrodes. In the developing region, the toner hopping on the surface of the toner carrier is attracted to an electrostatic latent image formed on the photoreceptor. The attracted toner is attached to the electrostatic latent image of the photoreceptor, which is thus developed to form a toner image.

In such a hopping developing system where the electrostatic latent image is developed by attaching the hopping toner to the electrostatic latent image, it may be possible to implement a low voltage development due to an extremely small potential difference between the electrostatic latent image and a bare surface exposed around the electrostatic latent image of the photoreceptor. Further, in the hopping developing system, the potential difference between the electrostatic latent image and the bare surface may be reduced approximately several tens μV, which may not be realized by a one-component developing system in which the development is carried out by utilizing toner attached to a surface of a developing roller, or a two-component developing system where the development is carried out by utilizing toner attached to carrier particles carried on a surface of the developing roller. Thus, the reduction in the potential difference may reduce the load caused by the potential difference on the surface of the photoreceptor to elongate the life of the photoreceptor.

In the hopping developing system, in order to stabilize the amount of toner transferred to the developing region, there is proposed a developing device that is provided with a regulator blade to regulate a thickness of a toner layer on the surface of the toner carrier roller. In this developing device, the amount of toner transferred to the developing region is regulated by bringing the regulator blade into contact with the surface of the toner carrier roller before entering into the developing region. Further, in the development device having the above configuration, the toner layer may be regulated to a certain thickness by applying a direct (DC) voltage having a polarity the same as the polarity of toner charge to the regulator blade.

However, the related art image forming apparatus having the hopping developing system only includes a power supply to generate the above-described periodic pulse voltages as a power supply to generate bias applied to various components and members of the developing device. However, if the image forming apparatus having the hopping developing system is further provided with a direct-current (DC) power supply in addition to the above power supply to generate a periodic pulse voltage, the cost may be increased.

SUMMARY OF THE INVENTION

It is a general object of at least one embodiment of the present invention to provide a developing device, an image forming apparatus and an image forming method capable of regulating a toner layer at a predetermined thickness without having a direct-current power supply for supplying a direct voltage specifically to a toner layer thickness regulator member, which substantially eliminate one or more problems caused by the limitations and disadvantages of the related art.

In one embodiment, there is provided an image forming apparatus that includes an electrostatic latent image carrier configured to carry an electrostatic latent image thereon; a developing device including a toner carrier formed of a base carrying toner on an endless surface thereof, first electrodes aligned along a surface direction of the base and to which a first periodic pulse voltage is periodically applied, and second electrodes aligned along the surface direction of the base and to which a second periodic pulse voltage having a phase differing from a phase of the first periodic pulse voltage is periodically applied, the developing device configured to develop the electrostatic latent image carried on the surface of the electrostatic latent image carrier by transferring the toner on the surface of the toner carrier to a developing region formed between the toner carrier and the electrostatic latent image carrier by surface movement of the toner carrier while causing the toner to hop between the first electrodes and the second electrodes on the surface of the toner carrier, and attaching the toner hopping therebetween to the electrostatic latent image carried on the surface of the electrostatic latent image carrier; a pulsed power supply including a first pulse output unit configured to output the first periodic pulse voltage having a mean potential with a polarity the same as a polarity of a normal toner charge, and a second pulse output unit configured to output the second periodic pulse voltage; a smoothing circuit configured to make the first periodic pulse voltage output from the first pulse output unit smooth to generate a smoothed first periodic pulse voltage as a direct voltage; and a toner layer thickness regulator member configured to regulate, on receiving the direct voltage generated from the smoothing circuit, a thickness of the toner layer on the surface of the toner carrier in a region between a toner supply position at which toner is supplied and the developing region formed between the toner carrier and the electrostatic latent image carrier before the toner layer on the surface of the toner carrier enters into the developing region.

In another embodiment, there is provided a method for forming an image in an image forming apparatus having an electrostatic latent image carrier, a developing device having a toner carrier on which first electrodes and second electrodes are formed and a toner supply unit supplying toner to the surface of a toner carrier to form a toner layer thereon, a pulsed power supply having a first pulse output unit outputting a first periodic pulse voltage and a second pulse output unit outputting a second periodic pulse voltage, a toner layer thickness regulator member and a smoothing circuit. The method includes carrying an electrostatic latent image; developing the electrostatic latent image by transferring the toner carried on the surface of the toner carrier by surface movement of the toner carrier to a developing region formed between the toner carrier and the electrostatic latent image carrier while causing the toner on the surface of the toner carrier to hop between the first electrodes aligned along a surface direction of the toner carrier and to which the first periodic pulse voltage is periodically applied and the second electrodes aligned along the surface direction of the toner carrier and to which the second periodic pulse voltage having a phase differing from a phase of the first periodic pulse voltage is periodically applied, and attaching the toner hopping therebetween to the electrostatic latent image carried on the surface of the electrostatic latent image carrier; outputting the first periodic pulse voltage having a mean potential with a polarity the same as a polarity of a normal toner charge; making the first periodic pulse voltage smooth to generate a smoothed first periodic pulse voltage as a direct voltage and applying the generated direct voltage the toner layer thickness regulator member; regulating, on the application of the generated direct voltage to the toner layer thickness regulator member, the thickness of the toner layer on the surface of the toner carrier in a region between a toner supply position at which the toner is supplied and the developing region formed between the toner carrier and the electrostatic latent image carrier before the toner layer on the surface of the toner carrier enters into the developing region.

In another embodiment, there is provided an image forming apparatus that includes an electrostatic latent image carrying means for carrying an electrostatic latent image; a developing means for developing the electrostatic latent image on the electrostatic latent image carrying means by transferring toner carried on a surface of a toner carrier by surface movement of the toner carrier to a developing region formed between the toner carrier and the electrostatic latent image carrying means while causing the toner on the surface of the toner carrier to hop between first electrodes aligned along a surface direction of the toner carrier and to which a first periodic pulse voltage is periodically applied and second electrodes aligned along the surface direction of the toner carrier and to which a second periodic pulse voltage having a phase differing from a phase of the first periodic pulse voltage is periodically applied, and attaching the toner hopping therebetween to the electrostatic latent image carried on the surface of the electrostatic latent image carrying means; a pulsed power supplying means for outputting the first periodic pulse voltage having a mean potential with a polarity the same as a polarity of a normal toner charge and outputting the second periodic pulse voltage; a smoothing means for making the first periodic pulse voltage smooth to generate a smoothed first periodic pulse voltage as a direct voltage; and a toner layer thickness regulating means for regulating, on receiving the applied direct voltage, the thickness of the toner layer on the surface of the toner carrier in a region between a toner supply position at which the toner is supplied and a developing region formed between the toner carrier and the electrostatic latent image carrying means before the toner layer on the surface of the toner carrier enters into the developing region.

BRIEF DESCRIPTION OF THE DRAWINGS

Other objects and further features of embodiments will be apparent from the following detailed description when read in conjunction with the accompanying drawings, in which.

DESCRIPTION OF THE PREFERRED EMBODIMENTS

Figure 1:
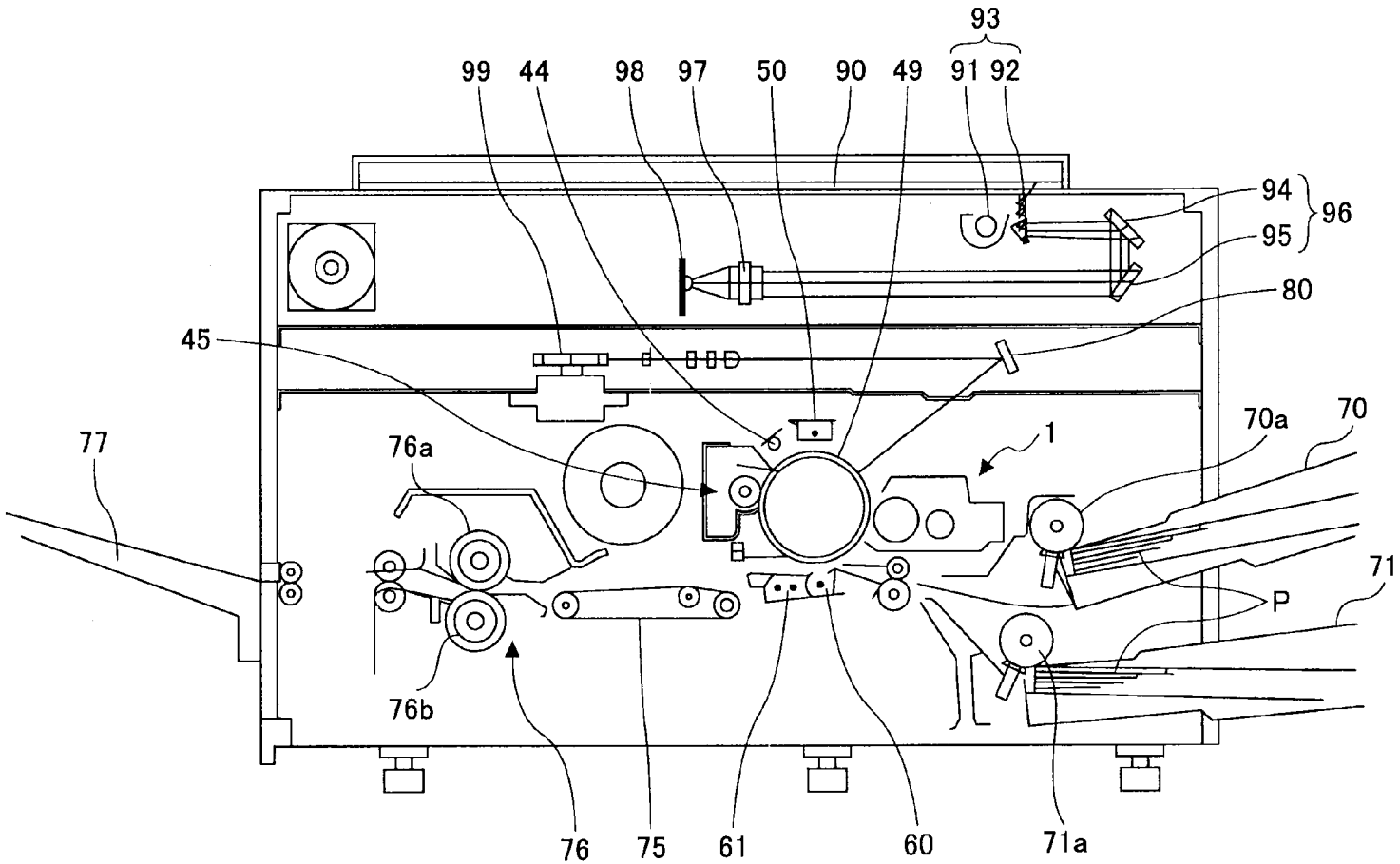
FIG. 1 is a schematic configuration diagram illustrating a copier according to an embodiment.

In the following, embodiments of the present invention will be described with reference to the accompanying drawings. An image forming apparatus according to an embodiment utilized as a copier employs a hopping developing system. FIG. 1 is a schematic configuration diagram illustrating the copier according to an embodiment. The copier according to an embodiment includes a photoreceptor drum 49 as a latent image carrier, which is rotationally driven in a clockwise direction in FIG. 1. When an operator places a document (not illustrated) on a contact glass 90 and presses a print-start switch (not illustrated), a document image is read while moving a first scanner system 93 having a document light source 91 and a mirror 92 and a second scanner system 96 having mirrors 94 and 95. The document image scanned is then read as an image signal by an image reader 98 arranged at a rear side of a lens 97, and the read image signal is converted into a digital signal utilized for image processing. The digital signal utilized for image processing drives a laser diode (LD) to emit a laser beam. The emitted laser beam is reflected off a polygon mirror 99 and the reflected laser beam scans the photoreceptor drum 49 via a mirror 80. The photoreceptor drum 49 is, before being scanned with the reflected laser beam, uniformly charged by a charger 50. When the reflected laser beam scans a surface of the photoreceptor drum 49, an electrostatic latent image is formed on the surface of the photoreceptor drum 49.

Subsequently, when a developing device 1 carries out a developing process to attach toner to the electrostatic latent image formed on the surface of the photoreceptor drum 49, a toner image is formed on the surface of the photoreceptor drum 49. The toner image on the surface of the photoreceptor drum 49 is carried to a transfer position facing a transfer charger 60 with a rotational movement of the photoreceptor drum 49. Meanwhile, a recording sheet P is fed into the transfer position by a first sheet feeder 70 having a first sheet feeder roller 70*a* or by a second sheet feeder 71 having a second sheet feeder roller 71*a* such that a position of the recording sheet P matches a position of the toner image on carried the surface of the photoreceptor drum 49 at the transfer position. The toner image on the surface of the photoreceptor drum 49 is then transferred onto the recording sheet P by corona discharge of the transfer charger 60.

The toner image transferred onto the recording sheet P is detached from the surface of the photoreceptor drum 49 by corona discharge of a separation charger 61, and the detached recording sheet P on which the toner image is transferred is carried by a transfer belt 75 toward a fixing device 76. In the fixing device 76, the recording sheet P is sandwiched in a fixing nip formed of a fixing roller 76*a* having a heater source such as a halogen lamp and a pressure roller 76*b* pressing against the fixing roller 76*a*. The toner image is fixed on a surface of the recording sheet P by the application of pressure and heat while being sandwiched in the fixing nip, and the recording sheet P on which the toner image is fixed is discharged to a discharge tray 77 arranged outside of the copier.

Thereafter, residual toner remains attached on the surface of the photoreceptor drum 49 after being passed through the transfer position is removed by a cleaner device 45. The surface of the photoreceptor drum 49 from which the residual toner is removed is then statically discharged for a next latent image formation.

Figure 2:
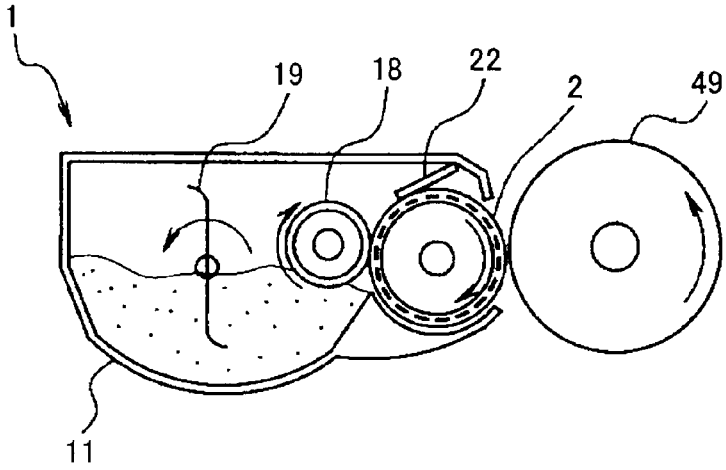
FIG. 2 is a schematic configuration diagram illustrating a photoreceptor and a developing device provided in the copier.

FIG. 2 is a schematic configuration diagram illustrating the photoreceptor drum 49 and the developing device 1 arranged in the copier according to an embodiment. In FIG. 2, the photoreceptor drum 49 is rotationally driven by a (not-illustrated) drive unit in a clockwise direction. The developing device 1 having a toner carrier roller 2 is arranged on the left hand side of the photoreceptor drum 49 as illustrated in FIG. 2.

The developing device 1 includes the toner carrier roller 2, a toner supply roller 18, a mixing paddle 19 and a toner layer thickness regulator blade 22. The toner supply roller 18 scoops toner from a toner container within the developing device 1 and carries the scooped toner on its spongy roller surface while being rotationally driven by a (not-illustrated) drive unit in a clockwise direction in FIG. 2. FIG. 2 illustrates an example of a rotational direction of the toner supply roller 18 as a counter direction, which is a direction reverse to the rotational direction of the toner carrier roller 2 at a contact position between the toner supply roller 18 and the toner carrier roller 2. However, the rotational direction of the toner supply roller 18 is not limited to the counter direction, and may be a forward direction, which is a direction the same as the rotational direction of the toner carrier roller 2 at the contact position between the toner supply roller 18 and the toner carrier roller 2.

The toner carried on the surface of the toner supply roller 18 is supplied to the toner carrier roller 2 at the contact position between the toner supply roller 18 and the toner carrier roller 2. The amount of toner supplied to the toner carrier roller 2 may be adjusted by the amount of a supply bias applied to a cored bar of the toner supply roller 18. Note that the supply bias may be a direct (DC) voltage, an alternating voltage, or a bias obtained by superimposing the alternating voltage on the DC voltage. The copier according to an embodiment employs a periodic pulse voltage that is the alternating voltage.

The toner supplied on the surface of the toner carrier roller 2 rotationally travels with the rotation of the toner carrier roller 2 in the clockwise direction in FIG. 2 while hopping on the surface of the toner carrier roller 2. The principle of causing the toner to hop on the surface of the toner carrier roller 2 is described later in more detail.

A free end of a cantilever toner layer thickness regulator blade 22 is brought into contact with a region of the surface of the toner carrier roller 2 having passed through the contact position with the toner supply roller 18 and not having entered the developing region facing the photoreceptor drum 49. While the toner hopping on the surface of the toner carrier roller 2 rotationally travels with the rotation of the toner carrier roller 2 in the clockwise direction in FIG. 2, the thickness toner layer formed of the toner hopping on the surface of the toner carrier 2 is regulated by the toner layer thickness regulator blade 22 before the entrance into the contact position between the toner carrier roller 2 and the toner layer thickness regulator blade 22. When the regulated toner layer carried on the surface of the toner carrier roller 2, the toner that is hopping again on the surface of the toner carrier roller 2 is carried to the developing region.

As illustrated in FIG. 2, the outer circumferential surface of the toner carrier roller 2 is partially exposed from an opening of a casing 11 of the developing device 1. This exposed part of the outer circumferential surface of the toner carrier roller 41 faces the photoreceptor drum 49 via a gap of several tens to several hundred μm. A facing position between the toner carrier roller 2 and the photoreceptor drum 49 corresponds to the developing region of the copier according to an embodiment. In the developing region, the toner hopping on the surface of the toner carrier 2 is attracted to an electrostatic latent image formed on the photoreceptor drum 49 and the attracted toner is eventually attached to the electrostatic latent image. The electrostatic latent image is thus developed by the toner attachment to form a toner image. When the toner hopping on the surface of the toner carrier roller 2 passes through the developing region, residual toner not used for the development and remaining on the surface of the toner carrier roller 2 return to the developing region with the rotation of the toner carrier roller 2.

Next, a specific configuration of the toner carrier roller 2 utilized in the copier according to an embodiment is described.

Figure 3:
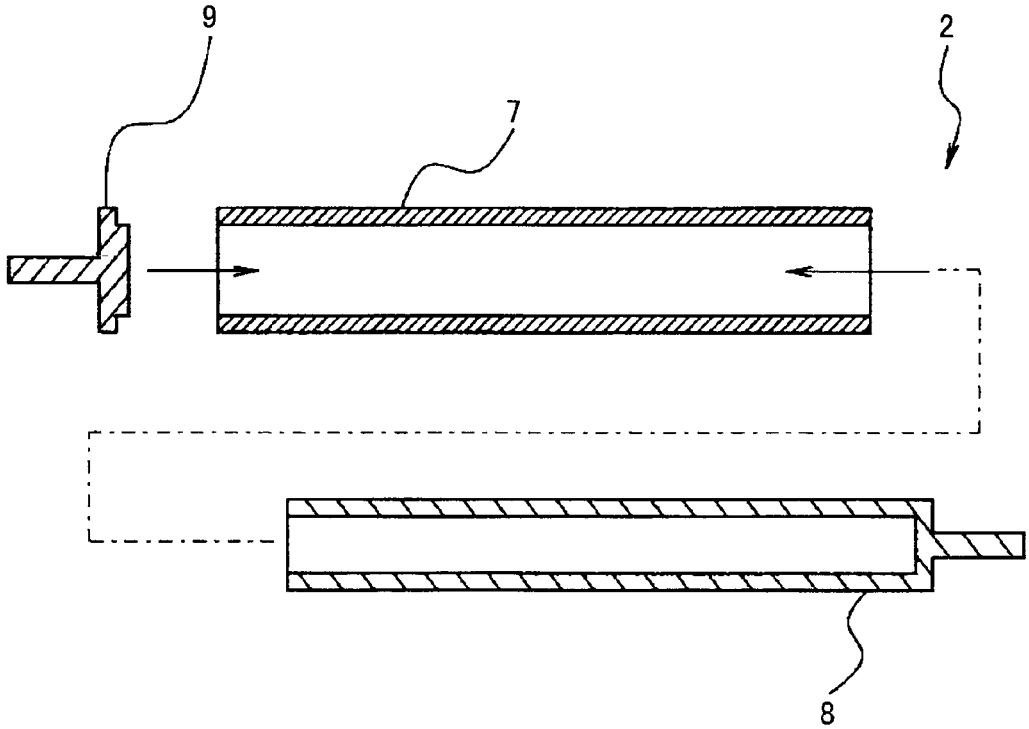
FIG. 3 is an exploded longitudinal-sectional diagram illustrating a toner carrier roller provided in the developing device illustrated in FIG. 2.
Figure 4:
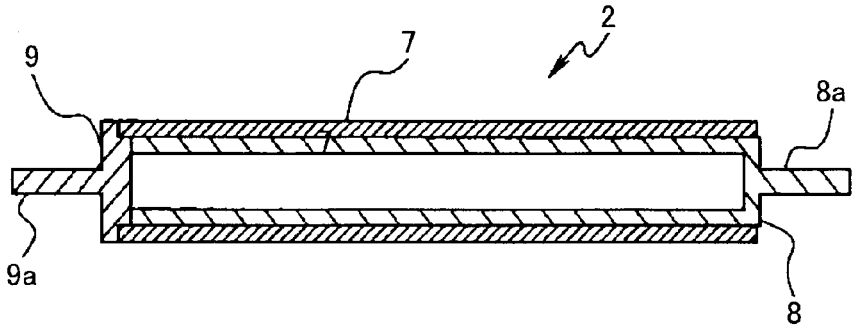
FIG. 4 is a longitudinal-sectional diagram illustrating the toner carrier roller illustrated in FIG. 3.

FIG. 3 is an exploded longitudinal-sectional diagram illustrating the toner carrier roller 2. FIG. 4 is a longitudinal-sectional diagram illustrating the toner carrier roller 2. As illustrated in FIGS. 3 and 4, the toner carrier roller 2 includes a cylindrical base 7, a first flange 9 fitted with one end of the cylindrical base 7 in a longitudinal direction, and a cored bar 8 (i.e., utilized as a first pulse electrode) inserted from the other end of the cylindrical base 7 in the longitudinal direction. The cylindrical base 7 is formed of an insulator material such as plastic. The first flange 9 is formed of a metallic material and includes a rotational shaft 9*a* rotationally received by a (not-illustrated) bearing on one end of the toner carrier roller 2 in the longitudinal direction. The cored bar 8 utilized as the first pulse electrode includes a rotational shaft 8*a* rotationally received by a not-illustrated bearing on the other end of the toner carrier roller 2 in the longitudinal direction.

Figure 5:
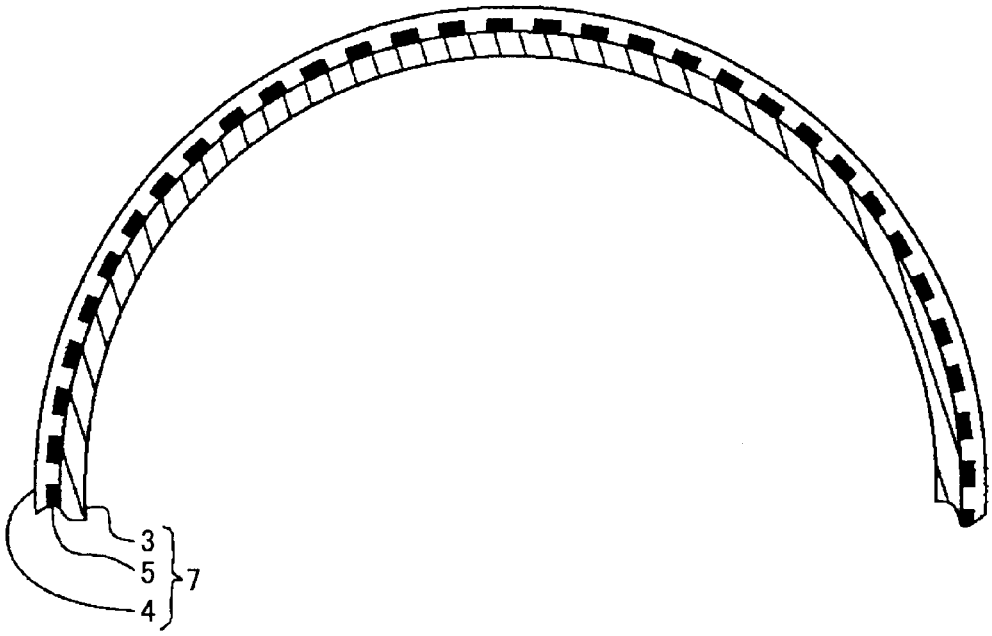
FIG. 5 is a partial cross-sectional diagram illustrating a cylindrical base of the toner carrier roller illustrated in FIG. 4.

FIG. 5 is a partial cross-sectional diagram illustrating the cylindrical base 7 of the toner carrier roller 2 illustrated in FIG. 4. The cylindrical base 7 includes a cylindrical base layer 3 formed of an insulator material, plural second pulse electrodes 5 extended in a cylindrically longitudinal direction of the base layer 3 and arranged on a surface of the base layer 3 at predetermined pitches in a circumferential direction of the base layer 3, and a surface layer 4 formed of an insulator material arranged such that the surface layer 4 covers the second pulse electrodes 5 and the base layer 3. The base layer 3 formed of the insulator material such as polycarbonate or melamine alkyd includes a thickness range of 3 to 50 μm.

The second pulse electrodes 5 formed on the surface of the base layer 3 are made of metal such as aluminum, copper, silver, and the like. Various methods may be employed for forming such second pulse electrodes 5. For example, the second pulse electrodes 5 may be formed by forming a metallic film on the base layer 3 by plating or vacuum deposition and then forming the metallic film in a ladder-like shape (see FIG. 7) by photoresist etching. Alternatively, the ladder-like second pulse electrodes 5 may be formed by attaching conductive paste on the base layer 3 by inkjet printing or screen printing.

Examples of the insulator material forming the surface layer 4, which covers the base layer 3 and the second pulse electrodes 5, include silicone, nylon (registered trade mark), urethane, melamine alkyd, polycarbonate, and the like. The surface layer 4 may be formed by spraying or dipping.

Figure 6:
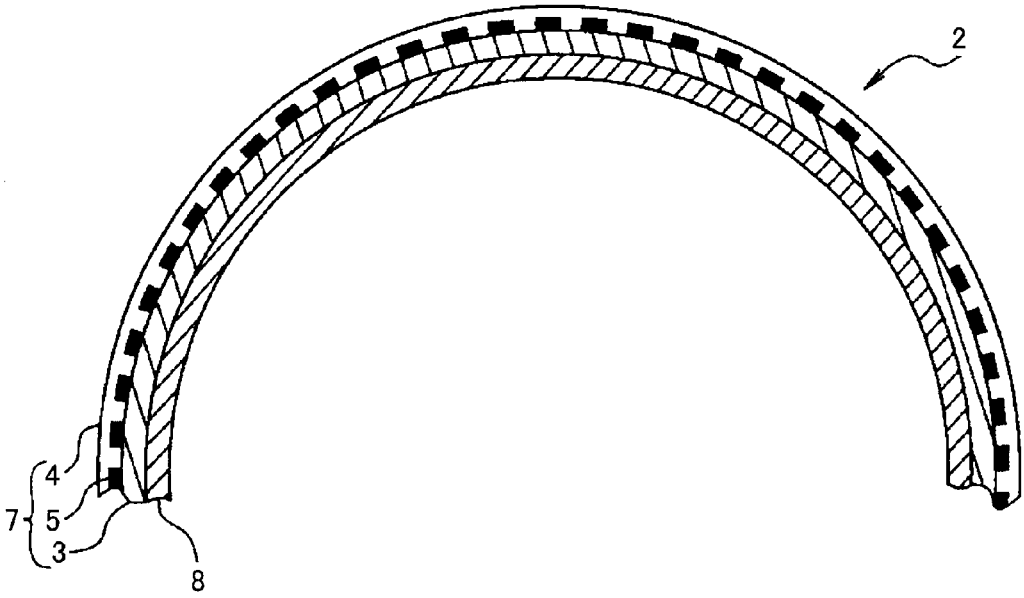
FIG. 6 is a partial cross-sectional diagram illustrating the cylindrical base and a cored bar fitting inside the cylindrical base.

FIG. 6 is a partial cross-sectional diagram illustrating the cylindrical base 7 and a cored bar 8 fitting inside the cylindrical base 7. The cored bar 8 is formed by molding a metallic material such as stainless steel or aluminum in a cylindrical shape. Alternatively, the first electrode formed by forming a conductive layer of a metallic layer such as aluminum or copper layer over a surface of a cylinder made of polyacetal (POM) or polycarbonate (PC) may be utilized in place of the cored bar 8. The cored bar 8 is fitted inside the base 7 such that an outer periphery of the cored bar 8 is closed attached to an inner periphery of the base 7. With this configuration, a surface of the cored bar 8 may be exposed between the adjacent second pulse electrodes 5 in a circumferential direction.

Figure 7:
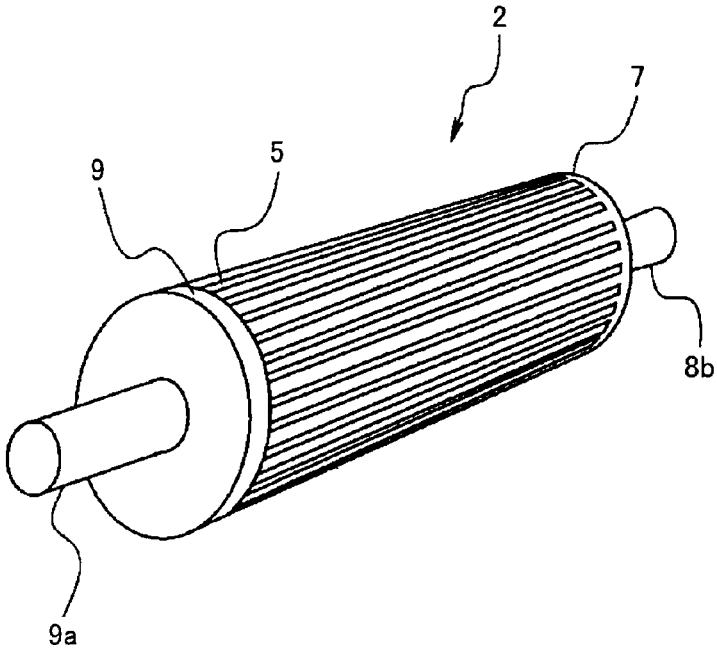
FIG. 7 is a perspective diagram illustrating the toner carrier roller.
Figure 8:
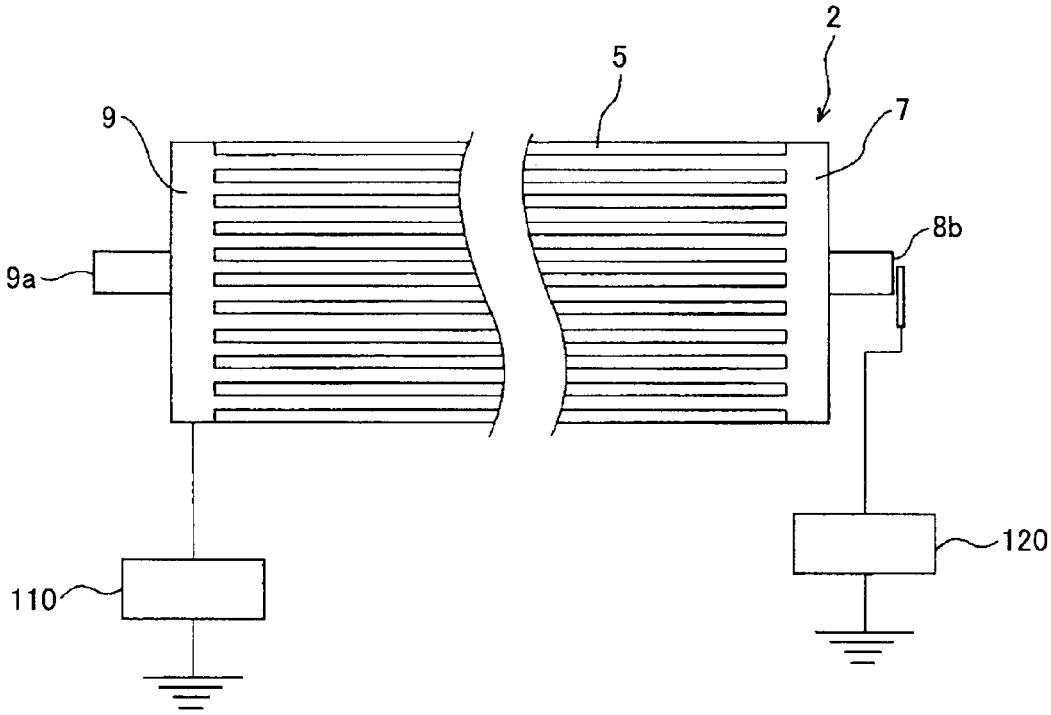
FIG. 8 is a front diagram illustrating the toner carrier roller.

FIG. 7 is a perspective diagram illustrating the toner carrier roller 2. FIG. 8 is a front diagram illustrating the toner carrier roller 2. In FIGS. 6 and 7, since the surface layer 4 entirely covers the second pulse electrodes 5 formed on the base 7, the second pulse electrodes 5 are not viewable in practice. However, the second pulse electrodes 5 are illustrated by omitting the depiction of the surface layer 4 for convenience of illustration.

The first metallic flange 9 is attached to one ends of the second pulse electrodes 5. The first flange 9 is connected to a second pulse output unit 110. Accordingly, a second periodic pulse voltage output from the second pulse output unit 110 is applied to the respective second pulse electrodes 5 via the first flange 9.

The rotational shaft 8*b* of the cored bar 8 is connected to a first pulse output unit 120. Accordingly, a first periodic pulse voltage output from the first pulse output unit 120 is applied to the cored bar 8.

Figure 9:
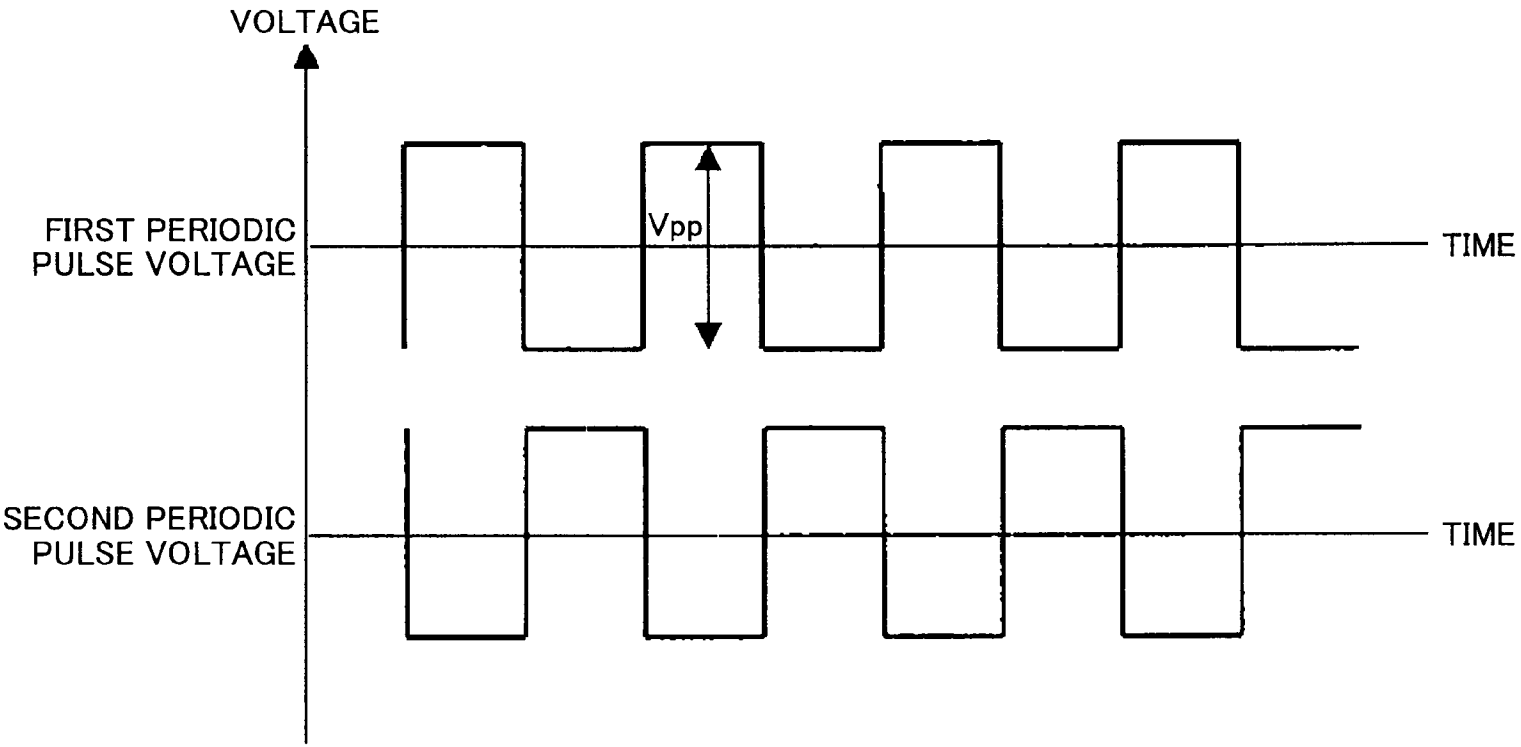
FIG. 9 is a waveform diagram illustrating a first waveform of a first periodic pulse voltage applied to the cored bar and a second waveform of a second periodic pulse voltage applied to second pulse electrodes in the developing device.

FIG. 9 is a waveform diagram illustrating a first waveform of the first periodic pulse voltage applied to the cored bar 8 and a second waveform of the second periodic pulse voltage applied to the second pulse electrodes 5 in the developing device 1. As illustrated in FIG. 9, the second periodic pulse voltage periodically generates pulses exhibiting a square pulse waveform. The second periodic pulse voltage includes a high potential peak value and a low potential peak value respectively having polarities the same as that of toner charge. Accordingly, the central values of the high and low potential values are the same as the polarity of the toner charge. The central value is a value between a potential of the electrostatic latent image formed on the photoreceptor surface and a potential of bare surface (potential uniformly charged by a charger). Meanwhile, the first pulse voltage has a phase exhibiting a pulse generating pattern opposite to a phase of the second periodic pulse voltage. The first periodic pulse voltage includes a high potential peak value and a low potential peak value respectively the same as those of the second periodic pulse voltage. The frequency f of the first periodic pulse voltage is in a range of 0.1 to 10 kHz.

Figure 10:
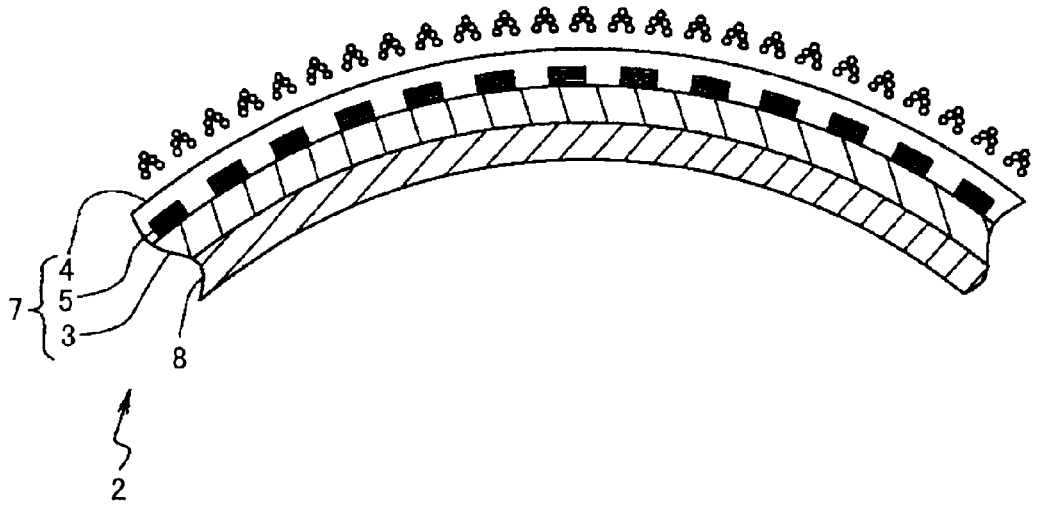
FIG. 10 is a partially enlarged cross-sectional diagram illustrating the toner carrier roller.

By the application of the first and second periodic pulse voltages to the cored bar 8 (i.e., first pulse electrode) and the second pulse electrodes 5, the toner carried on the surface of the toner carrier roller 2 reciprocally moves between the second pulse electrodes 5 and the cored bar 8 while hopping in the circumferential direction as illustrated in FIG. 10. Note that a toner floating layer formed on the surface of the toner carrier roller 2 by reciprocal movements between the second pulse electrodes 5 and the cored bar 8 is hereinafter called "flare".

Next, a configuration of the copier according to an embodiment is described. As illustrated in FIG. 2, when the amount of toner charge in the developing device 1 is changed with environmental variation, the amount of toner supplied from the toner supply roller 18 to the toner carrier roller 2 may be changed per unit time. If the amount of toner transferred to the developing region is changed due to the change in the amount of toner supplied to the toner carrier roller 2, the developed image may include inconsistent intensity. To overcome such inconsistent image intensity, the copier according to an embodiment includes the toner layer thickness regulator blade 22 to regulate the thickness of the toner floating layer on the surface of the toner carrier roller 2 in the following manner. After allowing the toner carrier roller 2 to pass through the toner supply position (contact position of the toner carrier roller 2 with the toner supply roller 18) in the circumferential direction at which the toner supply roller 18 supplies toner onto the toner carrier roller 2, the toner layer thickness regulator blade 22 is brought into contact with a region of the surface of the toner carrier roller 2 before the toner floating layer on the surface of the toner carrier roller 2 enters the developing region to adjust the thickness of the toner floating layer. The toner layer thickness regulator blade 22 is formed by coating a surface and a rear surface of a metallic plate with respective insulator layers.

Inventors of the present application have made a prototype developing device 1 illustrated in FIG. 2 and conducted experiments of regulating a toner layer thickness utilizing the toner layer thickness regulator blade 2. In a first experiment of regulating the thickness of the toner layer, the thickness of the toner layer was adjusted by the toner layer thickness regulator blade 22 having an electrically floating metallic plate. The result indicated that making the toner layer uniform was difficult after the thickness of the toner layer had been regulated. In a second experiment, the thickness of the toner layer was adjusted by applying a blade voltage made up of the alternating voltage to the metallic plate of the toner layer thickness regulator blade 22. The result indicated that the toner thickness was stabilized to some extent after the thickness of toner layer had been regulated. However, toner was attached to the bare surface portions of the photoreceptor drum 49 exposed between the adjacent electrodes, and hence the resulting developed image was contaminated due to the toner attached to the bare surface of the photoreceptor drum 49. This contamination due to the toner attached to the bare surface of the photoreceptor drum 49 resulted from the electrical discharge generated between the toner carrier roller 2, the second pulse electrodes and the metallic plate of the toner layer thickness regulator blade 22, which had oppositely charged the toner. As illustrated in FIG. 10, since the second pulse electrodes 5 on the toner carrier roller 2 were coated with the surface layer 4 and the toner layer thickness blade 22 was also coated with the insulator layer, there were two insulator layers between the second pulse electrodes 5 and the metallic plate of the toner layer thickness blade 22. However, despite having the two insulator layers between the second pulse electrodes 5 and the metallic plate of the toner layer thickness blade 22, the electrical discharge occurred via the two insulator layers. The above electric discharge occurred due to the fact that the potential difference between the second pulse electrodes 5 and the metallic plate of the toner layer thickness blade 22 temporarily became extremely large. More specifically, the second periodic pulse voltage utilized for causing the toner to hop was applied to the second pulse electrodes 5. The blade bias formed of the alternating voltage was applied to the metallic plate of the toner layer thickness regulator blade 22. Note the first periodic pulse voltage and the second periodic pulse voltage had mutually different voltage periods. In this condition, since the potential difference between the second pulse electrodes 5 and the metallic plate of the toner layer thickness regulator blade 22 became extremely large at a time where the high potential peak of the second periodic pulse voltage was synchronized with the low potential peak of the blade voltage, the electric discharge occurred via the two insulator layers.

Figure 11:
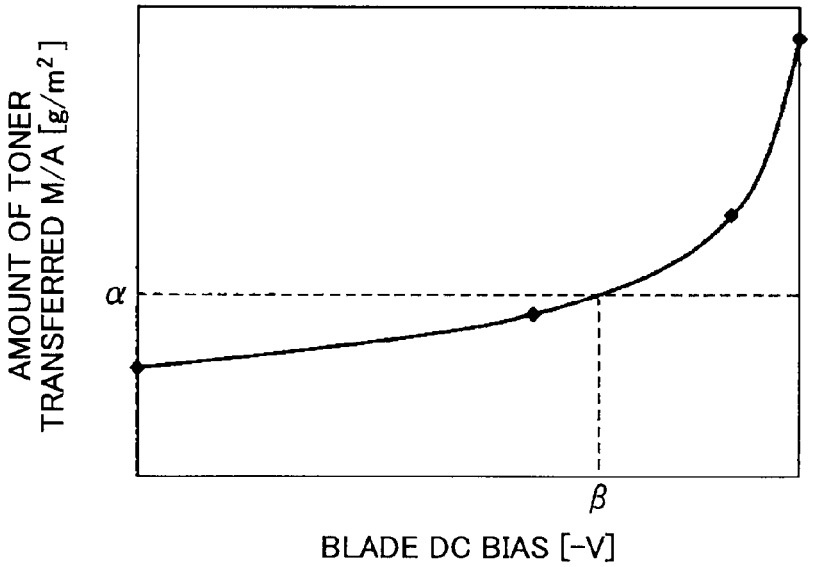
FIG. 11 is a graph illustrating a relationship between a blade bias composed of a negative DC voltage and the amount of toner transferred into a developing region.

In a third experiment, the thickness of the toner layer was adjusted by applying a negative direct (DC) voltage having the same polarity as the polarity of toner charge to the metallic plate of the toner layer thickness regulator blade 22. The result indicated that the thickness of the toner was uniformly adjusted without contaminating the bare surface of the photoreceptor drum 49 after the thickness of the toner layer had been regulated. FIG. 11 is a graph illustrating a relationship between the blade bias composed of the negative DC voltage and the amount of toner transferred into the developing region. As illustrated in FIG. 11, the amount of toner transferred to the developing region was increased as the blade bias was increased to the negative polarity side. Note that the blade bias may need to have the same value as the mean potential between the first periodic pulse voltage and the second periodic pulse voltage applied to the electrodes of the toner carrier roller 2, or a value greater in the negative polarity side of the toner charge.

Thus, in the third experiment, the amount of the toner was successfully stabilized by applying the blade voltage made up of the negative DC voltage to the toner layer thickness regulator blade 22. However, if a specific power supply for applying the blade bias is additionally provided, the cost may be increased. Thus, to overcome such cost increase, the copier according to an embodiment is configured such that the blade bias formed of the negative DC voltage may be applied to the toner layer thickness regulator blade 22 without having the specific power supply for applying the blade voltage formed of the DC voltage.

Figure 12:
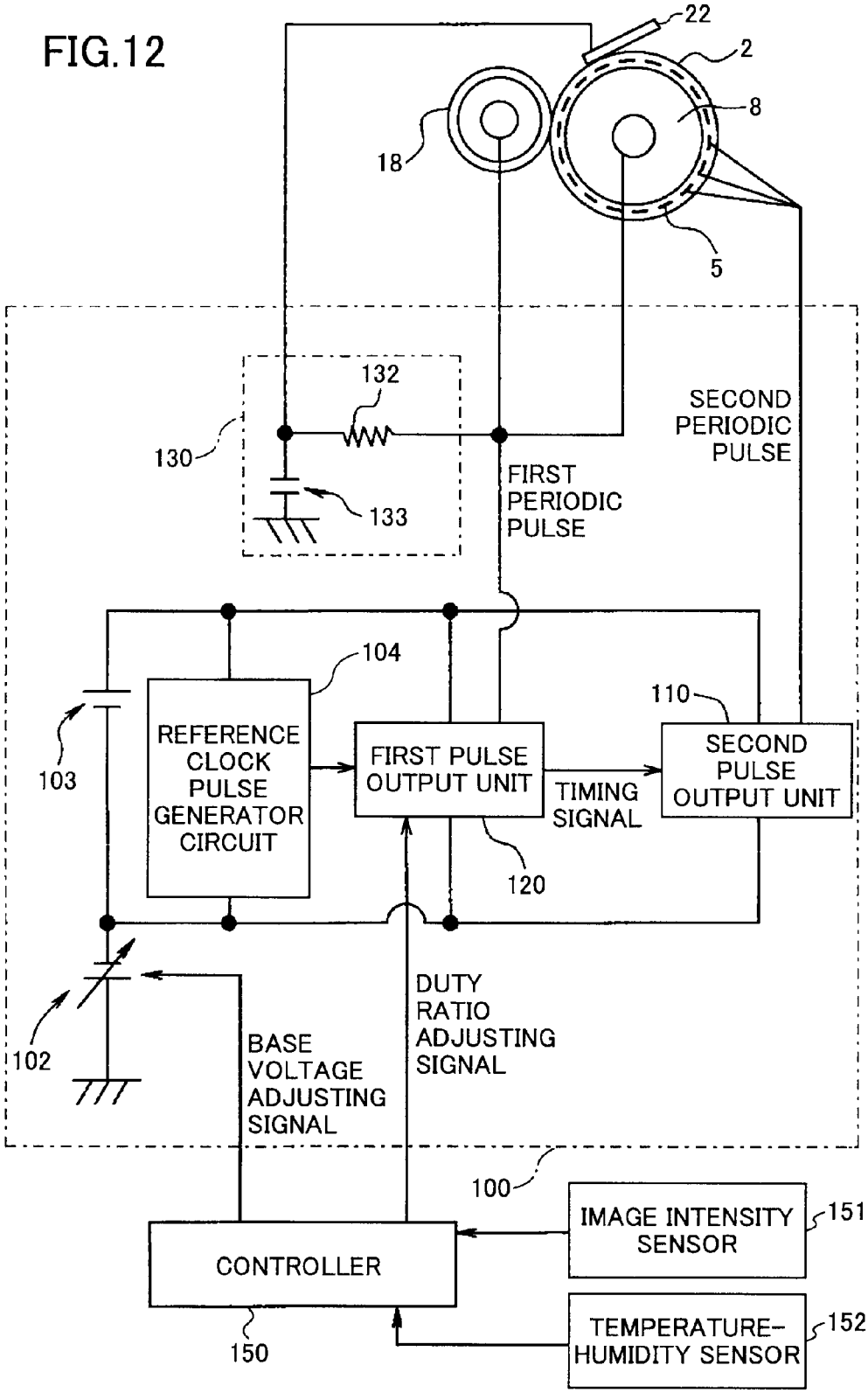
FIG. 12 is a block diagram illustrating a part of an electric circuit of the copier according to an embodiment.

FIG. 12 is a block diagram illustrating a part of an electric circuit of the copier according to an embodiment. The copier includes a pulsed power supply 100, a controller 150, an image intensity sensor 151 and a temperature-humidity sensor 152. The controller 150 configured to control various devices in the copier includes a central processing unit (CPU) utilized as a processor, a random access memory (RAM) and a read only memory (ROM) utilized data storages to execute operating processing or control programs. The controller 150 is connected to the image intensity sensor 151, the temperature-humidity sensor 152 and the pulsed power supply 100.

The image intensity sensor 151 is configured to detect image intensity of a patchy standard toner image formed on the (not-illustrated) photoreceptor drum and output the detected result to the controller 150. The temperature-humidity sensor 152 provided as an environment detector is configured to detect the temperature inside the copier and output the detected result as a temperature signal to the controller 150, or detect the humidity inside the copier and output the detected result as a humidity signal to the controller 150.

The pulsed power supply 100 includes a base voltage power supply 102, a superimposing voltage power supply 103, a reference clock pulse output unit circuit 104, a second pulse output unit 110, a first pulse output unit 120 and a smoothing circuit 130. The base voltage power supply 102 is configured to generate a base voltage formed of a DC voltage having the same value as the low potential peak value of the first periodic pulse voltage or the second periodic pulse voltage. The superimposing voltage power supply 103 is configured to generate a DC voltage having the same value as the peak-to-peak voltage (see Vpp in FIG. 9) of the first periodic pulse voltage or the second periodic pulse voltage as a superimposing voltage to superimpose the generated superimposing voltage to the base voltage. The superimposing voltage power supply 103 is connected to the reference clock pulse generator circuit 104, the second pulse output unit 110 and the first pulse output unit 120 in parallel with one another.

The reference clock pulse generator circuit 104 accurately outputs a reference clock pulse signal to the first pulse output unit 120 at a predetermined period. The first pulse output unit 120 may send the base voltage without change to an output side based on the reference clock pulse signal, or may superimpose the superimposing voltage to the base voltage based on the reference clock pulse signal and send the superimposed voltage to the output side. Accordingly, the first pulse output unit 120 outputs the first periodic pulse voltage having the base voltage as the low potential peak value and a voltage obtained by superimposing the superimposing voltage to the base voltage as the high potential peak value. The first pulse output unit 120 also outputs a timing signal to the second pulse output unit 110 every time the pulse of the first periodic pulse voltage output by itself is raised.

Similar to the first pulse output unit 120, the second pulse output unit 110 may also send the base voltage without change to the output side, or may superimpose the superimposing voltage to the base voltage and output the superimposed voltage to the output side. Accordingly, the second pulse output unit 110 outputs the second periodic pulse voltage having the base voltage as the low potential peak value and the voltage obtained by superimposing the superimposing voltage to the base voltage as the high potential peak value. The second pulse output unit 110 determines a timing of switching on or off of superimposing the superimposing voltage based on the timing signal sent from the first pulse output unit 120 to allow the second periodic pulse voltage has a phase opposite to that of the first periodic pulse voltage. The second periodic pulse voltage output from the second pulse output unit 110 is applied to the respective second pulse electrodes 5 of the toner carrier roller 2.

The output side of the first pulse output unit 120 is connected to the cored bar 8 of the toner carrier roller 2, a cored bar of the toner supply roller 18, and smoothing circuit 130. The first periodic pulse voltage output from the first pulse output unit 120 is applied to the cored bar 8 of the toner carrier roller 2 or the cored bar of the toner supply roller 18 without any change. The first periodic pulse voltage is smoothed and converted into a DC voltage by the smoothing circuit 130 having a resistor 131 and a capacitor 133, and the converted DC voltage is then applied as the blade voltage to the toner layer thickness regulator blade 22.

With this configuration, the smoothing circuit 130 makes the first periodic pulse voltage smooth, which is the negative mean voltage having the same polarity as the toner charge, to generate a smoothed first periodic pulse voltage as a negative DC voltage. The generated negative DC voltage is then applied to the toner layer thickness regulator blade 22 to regulate the toner layer in a predetermined thickness without separately having a specific DC power supply for applying the DC voltage to the toner layer thickness regulator blade 22.

Figure 13A:
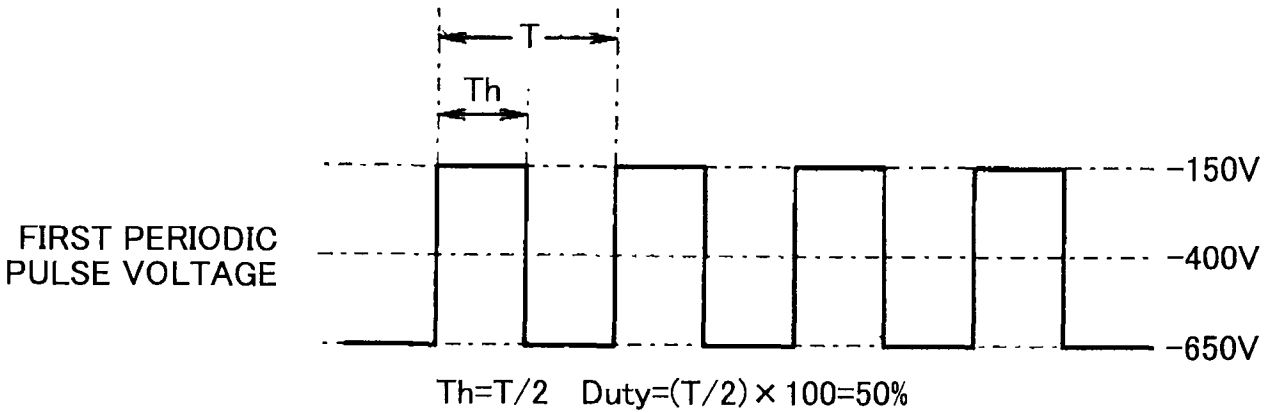
FIG. 13A is a waveform diagram illustrating a first waveform example of a first periodic pulse voltage.
Figure 13B:
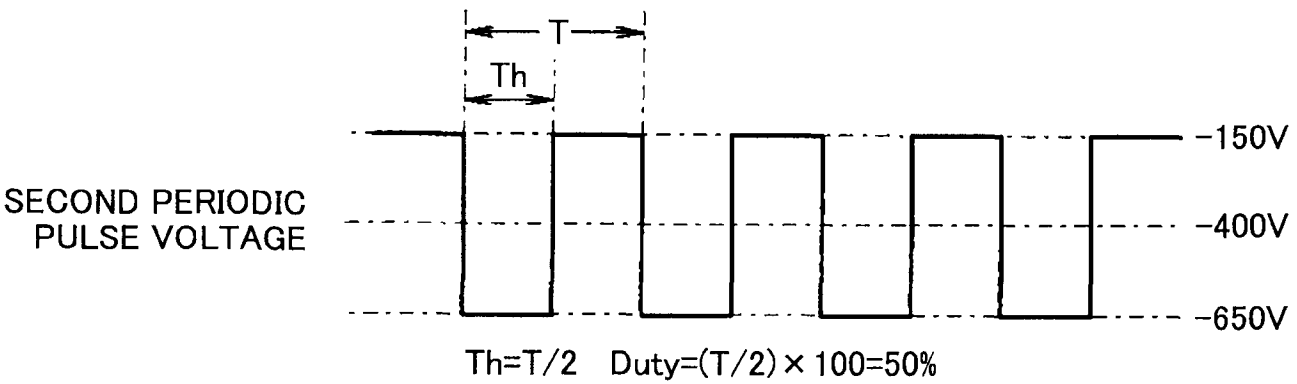
FIG. 13B is a waveform diagram illustrating a first waveform example of a second periodic pulse voltage.

FIG. 13A is a waveform diagram illustrating a first waveform example of the first periodic pulse voltage, and FIG. 13B is a waveform diagram illustrating a first waveform example of the second periodic pulse voltage. In the copier according to an embodiment, the bare surface of the photoreceptor drum 49 (not illustrated) is uniformly charged at approximately −800 V and the laser beam is applied to the bare surface of the photoreceptor drum 49 to reduce the negative potential of the laser beam applied portion of the bare surface. An electrostatic latent image having an approximately −50 V is thus formed on the surface of the photoreceptor drum 49. As illustrated in FIGS. 13A and 13B, the first pulse voltage and the second pulse voltage both include a duty ratio of 50%. The duty ratio is the ratio of the duration of the low potential pulse rising time (rising pulse in this example) to the period T. The less the duty ratio, the more high potential side the mean potential of the periodic pulse voltage shifts to. The low potential peak values of the first and the second periodic pulse voltages are each −150 V and the high potential peak values of the first and the second periodic pulse voltages are each −650 V. In the condition with these peak values and duty ratio of 50%, the mean potentials of the first and the second periodic pulse voltages are each −400 V. Thus, the mean potential of the surface of the toner carrier roller 2 may also be −400 V. The value of −400 V is lower than the bare surface potential −800 V of the photoreceptor drum 49 and higher than the potential of the electrostatic latent image. In such a condition, the toner having the same negative potential as the bare surface potential or the electrostatic latent image potential may be transferred from the toner carrier roller 2 to the electrostatic latent image formed on the photoreceptor drum 49. The electrostatic latent image is thus developed with the toner having such a negative potential.

When the first periodic pulse voltage passes through the smoothing circuit 130 illustrated in FIG. 12, the DC voltage smoothed by the smoothing circuit 130 may have approximately the same mean potential as that of the first periodic pulse voltage. That is, with the condition of the first periodic pulse voltage illustrated in FIG. 13A, the blade bias of approximately −400 V is applied to the toner layer thickness blade 22. Accordingly, the thickness of the toner layer is uniformly adjusted after the toner layer thickness blade 22 has passed through the toner layer. Note that the mean potential of the periodic pulse voltage=−400 V illustrated above is a mere example value with the default condition. Since the controller 150 of the copier according to an embodiment appropriately shifts the low potential peak value and the high potential peak value in the same amounts based on the result obtained from the developing performance to change the developing potential, a developing performance adjusting process to adjust the developing performance may be regularly carried out.

In the developing performance adjusting process, a patchy standard toner image is formed on the surface of the photoreceptor drum 49, and the image intensity sensor 151 detects image intensity (the amount of toner attached per unit area) of the patchy standard toner image output. If the detected result indicates the intensity lower or higher than the target intensity, the low potential peak value and the high potential peak value may be shifted. Accordingly, a target image intensity may be obtained by changing the developing potential that is the difference between the mean potential of the periodic pulse voltage and the electrostatic latent image potential.

The high potential peak value and low potential peak value of the periodic pulse voltage are changed as follows. That is, the base voltage power supply 102 may change the output value of the base voltage based on a base voltage adjusting signal transmitted from the controller 150. If the image intensity of the standard toner image is lower than the target image intensity, the controller 150 shifts the output value of the base voltage to the negative side by changing the base voltage adjusting signal. Thus, the image intensity is lowered by shifting the central value between the two peak potentials (central potential between the peak-to-peak voltage) of the first periodic pulse voltage or the second periodic pulse voltage to the negative side to increase the developing potential. In this manner, the image intensity of the standard toner image approaches the target image intensity. By contrast, if the image density of the standard toner image is higher than the target image density, the controller 150 shifts the output value of the base voltage to the positive side by changing the base voltage adjusting signal. Thus, the image intensity is increased by shifting the central value between the two peak potentials of the first periodic pulse voltage or the second periodic pulse voltage to the positive side to lower the developing potential. In this manner, the image intensity of the standard toner image approaches the target image intensity.

The image intensity may be stabilized by regularly conducting the above-described developing performance adjusting process. However, if the printing operation is successively conducted, in a drastic environmental change (i.e., temperature and humidity change) may occur inside the copier. Thus, the image intensity may change due to the change in the amount of toner charge (Q/M) inside the developing device. That is, the change in the amount of toner charge changes may change the thickness of the toner layer of the toner thickness regulator blade 22 has passed through the surface of the toner layer. Since the amount of toner transferred into the developing region per unit time is changed, the developing intensity may be changed accordingly.

To overcome such an effect, the capability of regulating the toner layer thickness held by the toner layer thickness regulator blade 22 may be changed by changing the blade bias applied to the toner layer thickness regulator blade 22 based on a detected result of a temperature-humidity degrees detected by the temperature-humidity sensor 152 (i.e., environment detector). Thus, the amount of change in the thickness of the toner layer caused by the change in the amount of toner charge may be offset by the change in the capability of regulating the toner layer thickness held by the toner layer thickness regulator blade 22. Accordingly, the thickness of the toner layer may be stabilized.

Figure 14A:
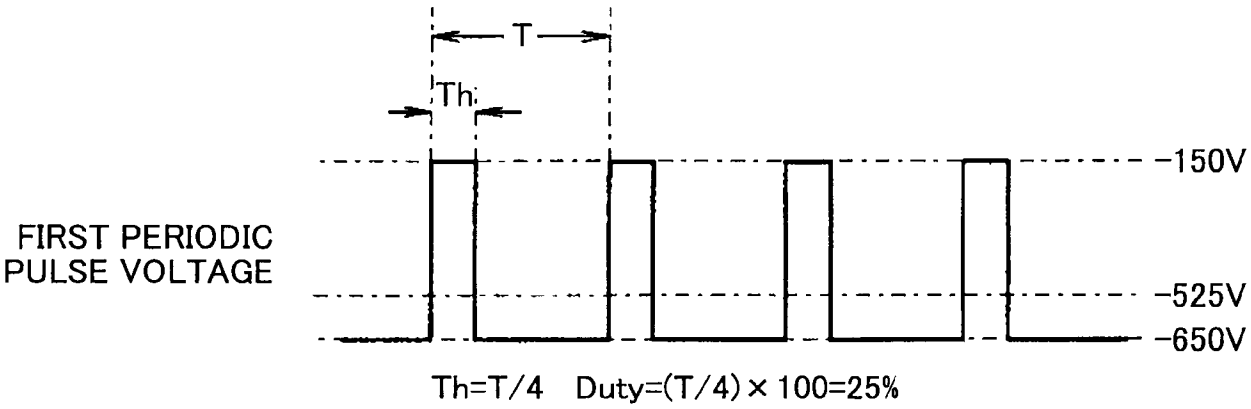
FIG. 14A is a waveform diagram illustrating a second waveform example of the first periodic pulse voltage.
Figure 14B:
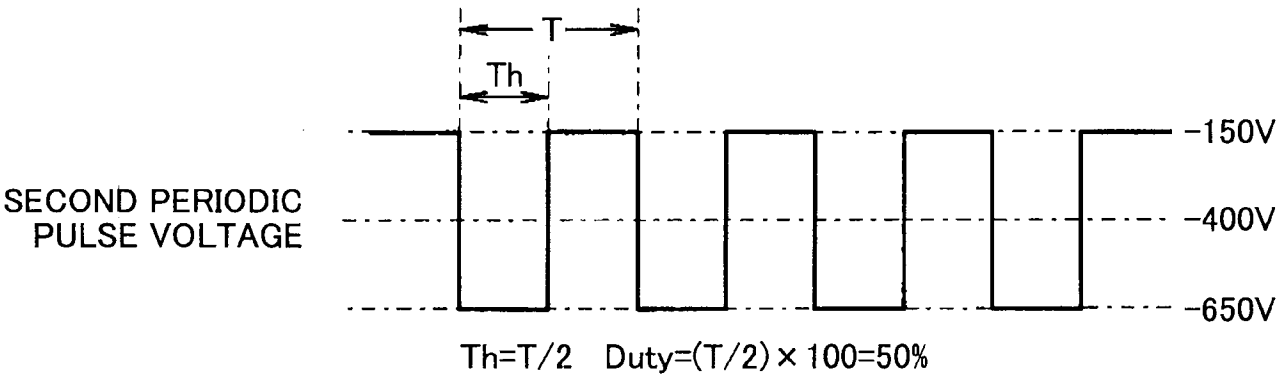
FIG. 14B is a waveform diagram illustrating a second waveform example of the second periodic pulse voltage.
Figure 15:
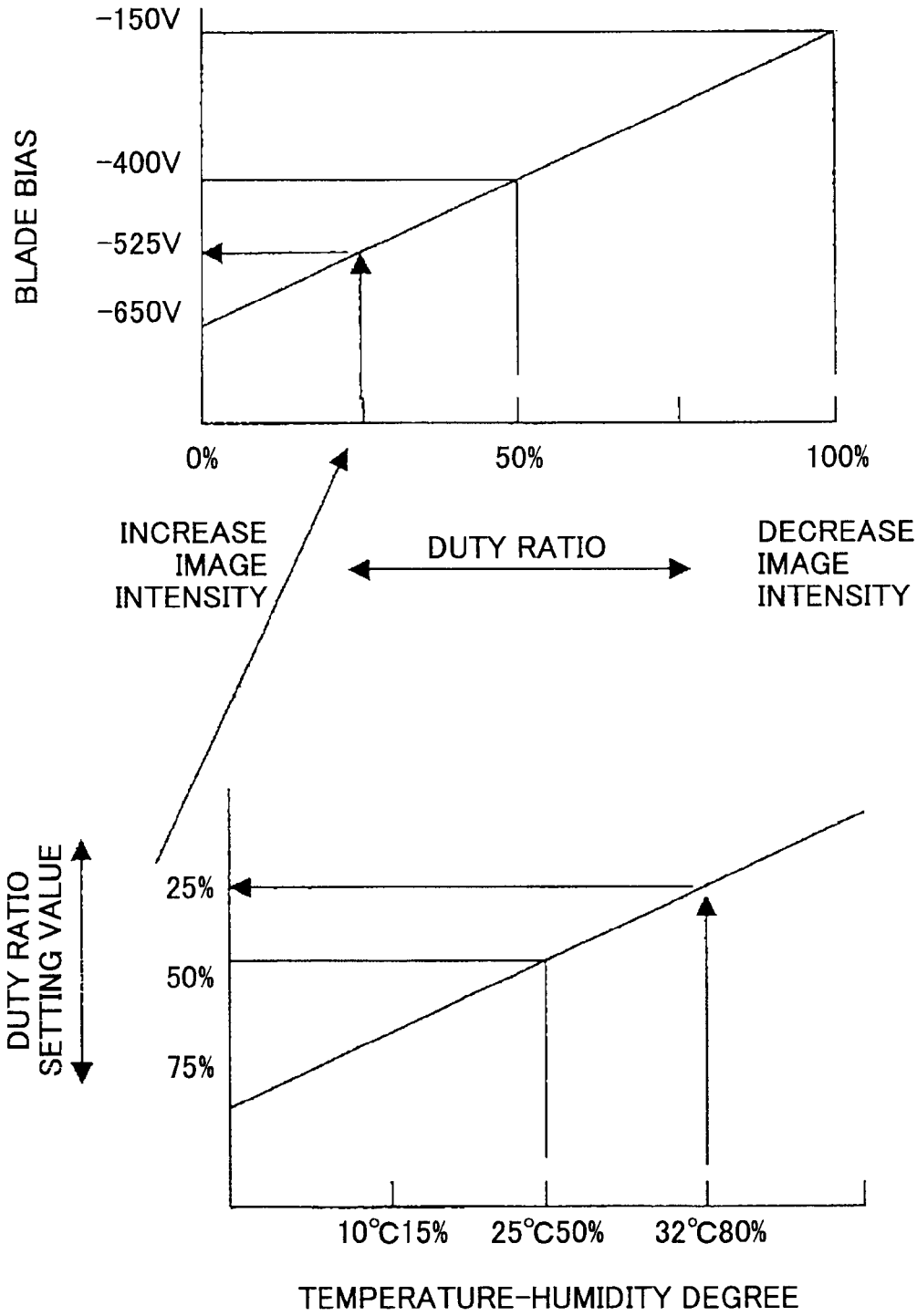
FIG. 15 is a diagram illustrating a relationship between temperature-humidity degree, a duty ratio setting value and a blade bias.

The blade bias may be changed in the following manner. The first pulse output unit 120 may change the duty ratio of the first periodic pulse voltage based on a duty ratio adjusting signal transmitted from the controller 150. The controller 150 may change the duty ratio of the first periodic pulse voltage by changing the duty ratio adjusting signal transmitted from the controller 150 based on a detected result of the temperature-humidity degrees detected by the temperature-humidity sensor 152. Accordingly, since the blade bias has the same potential as the mean potential of the first periodic pulse voltage, the blade bias may be changed by changing the mean potential of the first periodic pulse voltage. For example, the mean potential (=blade bias) of the first periodic pulse voltage may be adjusted to the same value as the central value (i.e., −400 V in FIG. 13A) of the peak-to-peak value by setting the duty ratio of the first periodic pulse voltage at 50%, under the condition of the temperature of 25° C. and the humidity of 50% as illustrated in FIG. 13A. By contrast, the mean potential (=blade bias) of the first periodic pulse voltage may be shifted to the more negative side from the central value (i.e., −525 V in FIG. 14A) of the peak-to-peak value by setting the duty ratio of the first periodic pulse voltage at 25%, under the condition of the temperature of 32° C. and the humidity of 80% illustrated in FIG. 14A. Thus, the reduced thickness of the toner layer caused by the decrease in the amount of toner charge due to the high temperature-high humidity environment may be offset by increasing the thickness of the toner layer by increasing the blade bias of the toner layer thickness regulator blade 22. Accordingly, the thickness of the toner layer may be stabilized. FIG. 15 is a diagram illustrating a relationship between the temperature-humidity degree, the duty ratio setting value and the blade bias.

Figure 16:
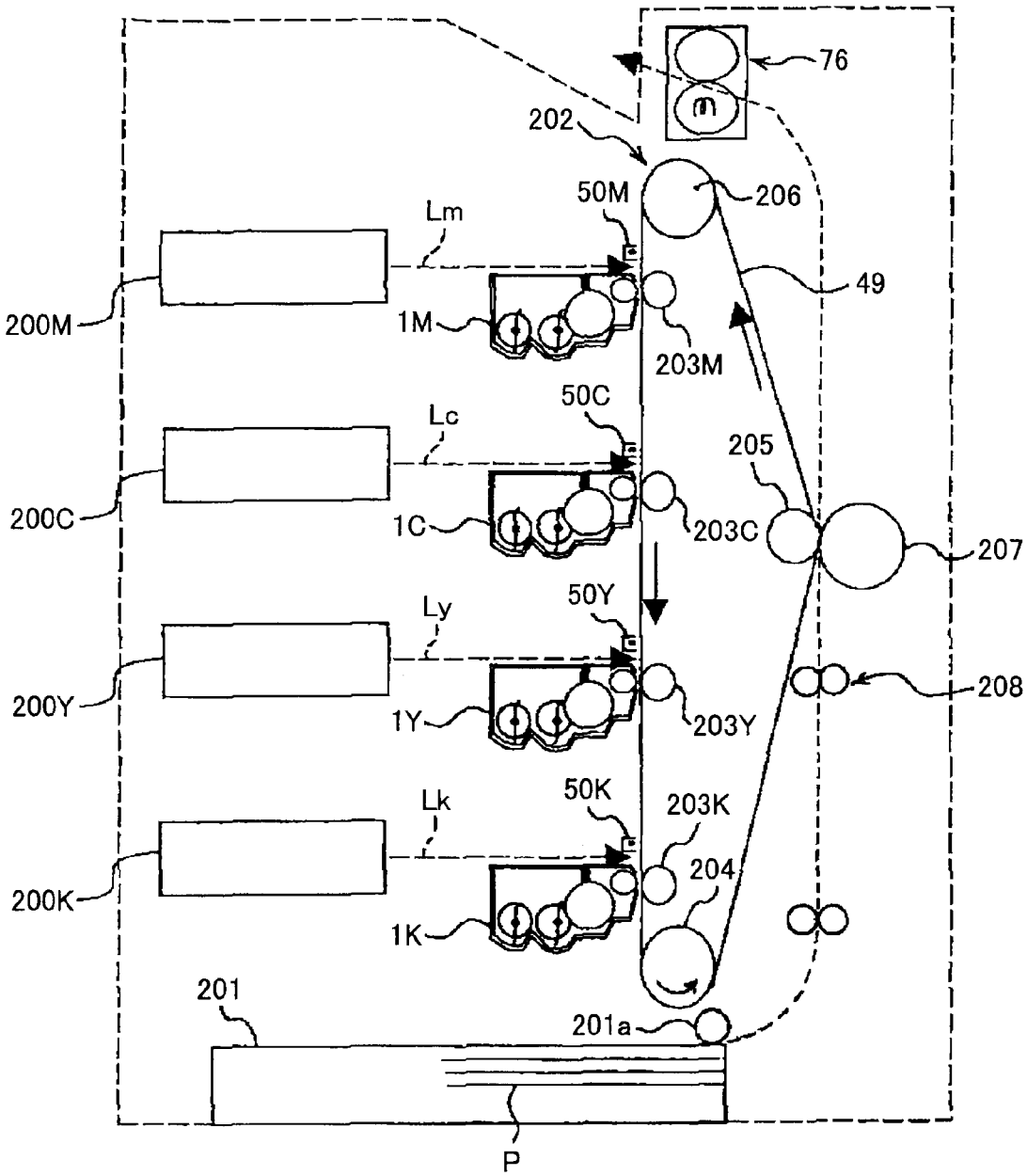
FIG. 16 is a schematic configuration diagram illustrating a printer unit of the copier according to an embodiment.

FIG. 16 is a schematic configuration diagram illustrating a printer unit of the copier according to an embodiment. The printer unit is configured to superimpose magenta, cyan, yellow and black (hereinafter also referred to as "M, C, Y and K") toner images to form a full-color image. The printer unit includes a belt unit 202, four process units corresponding to four M, C, Y and K colors, four optical writer units 200M, 200C, 200Y and 200K, a resist roller pair 208, a transfer roller 207, a fixing device 76, and a paper feeder cassette 201.

The belt unit 202 included an endless belt-type photoreceptor 49 that is looped over plural rollers such that the endless belt-type photoreceptor 49 is elongated in a vertical direction rather than in a horizontal direction as illustrated in FIG. 16. The endless belt-type photoreceptor 49 is rotationally driven such that the endless belt-type photoreceptor 49 travels in a clockwise direction indicated by arrows in FIG. 16. More specifically, the endless belt-type photoreceptor 49 is looped over a driving roller 204, a tension roller 206, a transfer backup roller 205, and four developing image facing-rollers 203M, 203C, 203Y and 203K to support the endless belt-type photoreceptor 49 from its rear surface side. The endless belt-type photoreceptor 49 is endlessly moved in a clockwise direction by the rotation of the driving roller 24 that is rotationally driven in a counter-clockwise direction by a (not-illustrated) drive unit. The left side tensioned surface (hereinafter called a "tensioned left surface") of the endless belt-type photoreceptor 49 in FIG. 16 is elongated in an approximately vertical direction.

The M, C, Y and K process units are arranged in the vertical direction on the left hand side of the tensioned left surface of the endless belt-type photoreceptor 49 such that the M, C, Y and K process units face the tensioned left surface of the endless belt-type photoreceptor 49. The M, C, Y and K process units respectively include developing devices 1M, 1C, 1Y and K, and chargers 50M, 50C, 50Y and 50K configured to uniformly charge the endless belt-type photoreceptor 49. The M, C, Y and K process units are supported by a (not-illustrated) common supporting unit. Each of the M, C, Y and K process units having the corresponding developing device and charger is attached into or detached from the printer case as a unit.

Among the developing devices 1M, 1C, 1Y and 1K, the developing device 1K (black) is arranged at a lowermost side in the vertical direction, and the charger 50K is arranged above the developing device 1K such that the charger 50K faces the tensioned left surface of the endless belt-type photoreceptor 49. Likewise, the developing device 1Y (yellow) is arranged directly above the developing device 1K, and the charger 50Y is arranged above the developing device 1Y such that the charger 50Y faces the tensioned left surface of the endless belt-type photoreceptor 49. Similarly, the developing device 10 (cyan) is arranged directly above the developing device 1Y, and the charger 50C is arranged above the developing device 10 such that the charger 50C faces the tensioned left surface of the endless belt-type photoreceptor 49. Moreover, the developing device 1M (magenta) is arranged directly above the developing device 1C, and the charger 50M is arranged above the developing device 1M such that the charger 50M faces the tensioned left surface of the endless belt-type photoreceptor 49.

The four optical writer units 200M, 200C, 200Y and 200K are arranged in the vertical direction on the left hand side of the developing devices 1M, 1C, 1Y and 1K that are also arranged in the vertical direction. The optical writer units 200M, 200C, 200Y and 200K drive (not-illustrated) four semiconductor lasers to emit respective optical writer laser beams Lm, Lc, Ly and Lk of M, C, Y and K colors based on image information transmitted from an externally arranged (not-illustrated) personal computer (PC) or scanner. The endless belt-type photoreceptor 49 is scanned while the optical writer laser beams Lm, Lc, Ly and Lk emitted from the four semiconductor lasers are deflected by a (not-illustrated) polygon mirror such that the deflected light beams are reflected off a (not-illustrated) reflector mirrors or are passed through (not-illustrated) optical lenses. Note that the optical scanning may be carried out by an LED array. Note also that the optical scanning may be carried out in darkness.

The endless belt-type photoreceptor 49 moves directly from upstream to downstream in the approximately vertical direction between the driving roller 204 arranged at the lowermost position and the tension roller 206 arrange at the uppermost position in the vertical direction. For example, the endless belt-type photoreceptor 49 may be uniformly charged with the negative polarity when the endless belt-type photoreceptor 49 passes through a position facing the charger 50M. The endless belt-type photoreceptor 49 is scanned by the optical writer laser beams Lm (Magenta), the endless belt-type photoreceptor 49 carries an electrostatic latent image of M color (hereinafter simply called an "M latent image") and then passes through a position facing the developing device 1M. At this moment, the M latent image optically written on the surface of the endless belt-type photoreceptor 49 is developed by the developing device 1M, thereby forming an M toner image.

The surface of the endless belt-type photoreceptor 49 now carrying the M toner image is uniformly charged again by the charger 50C and is then scanned by the optical writer laser beams Lc (Cyan), such that the endless belt-type photoreceptor 49 carries an electrostatic latent image of C color (hereinafter simply called a "C latent image") while traveling from upstream to downstream in the vertical direction. The C latent image optically written on the surface of the endless belt-type photoreceptor 49 is developed by the developing device 10, thereby forming a C toner image. At this moment, the entire region or partial region of the C toner image is developed while being superimposed on the M toner image already formed on the surface of the endless belt-type photoreceptor 49. The superimposed region includes a secondary color region composed of M and C colors.

The surface of the endless belt-type photoreceptor 49 now carrying the C toner image is uniformly charged again by the charger 50Y and is then scanned by the optical writer laser beams Ly (Yellow), such that the endless belt-type photoreceptor 49 carries an electrostatic latent image of Y color (hereinafter simply called a "Y latent image") while traveling from upstream to downstream in the vertical direction. The Y latent image optically written on the surface of the endless belt-type photoreceptor 49 is developed by the developing device 1Y, thereby forming a Y toner image. At this moment, the entire region or partial region of the Y toner image is developed while being superimposed on the M toner image, the C toner image, or the MC secondary color region already formed on the surface of the endless belt-type photoreceptor 49. The superimposed region includes an MY secondary color region, an CY secondary color region, or an MCY tertiary color region.

The surface of the endless belt-type photoreceptor 49 now carrying the Y toner image is uniformly charged again by the charger 50K and is then scanned by the optical writer laser beams Lk (Black), such that the endless belt-type photoreceptor 49 carries an electrostatic latent image of K color (hereinafter simply called a "K latent image") while traveling from upstream to downstream in the vertical direction. The K latent image optically written on the surface of the endless belt-type photoreceptor 49 is developed by the developing device 1Y, thereby forming a K toner image.

Thus, with the development by superimposing the M, C, Y and K toner images, a superimposed four color toner image is formed on an outer surface (outer surface of the loop) of the endless belt-type photoreceptor 49. Note that the chargers 50M, 50C, 50Y and 50K utilized in this embodiment are configured to uniformly charge the endless belt-type photoreceptor 49 by corona discharge.

When the endless belt-type photoreceptor 49 that has passed through a position facing the developing device 1K passes through a looped portion of the driving roller 204, the endless belt-type photoreceptor 49 relatively moves directly from downstream to upstream in the vertical direction between the driving roller 204 arranged at the lowermost position and the tension roller 206 arranged at the uppermost position. Then, the endless belt-type photoreceptor 49 moves further to enter a transfer nip between the transfer backup roller 205 and the transfer roller 207 (i.e., a looped portion of the transfer backup roller 205). In the looped portion of the transfer backup roller 205, the transfer roller 207 is brought into contact with the outer surface of the endless belt-type photoreceptor 49 to form the transfer nip between the transfer backup roller 205 and the transfer roller 207. The transfer backup roller 205 is grounded while the conductive transfer roller 207 is supplied with a transfer bias by a (not-illustrated) a bias application unit. Accordingly, transfer electric fields are formed at the nip between the transfer backup roller 205 and the transfer roller 207, which may electrostatically transfer the toner image from the transfer backup roller 205 side to the transfer roller 207 side.

Meanwhile, the paper feeder cassette 201 is configured to feed a recording sheet P contained in the cassette toward a paper-feeding path by rotationally driving a paper feed roller 201*a* at a predetermined timing. The recording sheet P fed from the paper feeder cassette 201 is sandwiched between the resist roller pair 208 arranged beneath the transfer nip between the transfer backup roller 205 and the transfer roller 207 as illustrated in FIG. 16. The resist roller pair 208 temporarily stops rotating as soon as the resist roller pair 208 catches (sandwiches) a fore-end of the recording sheet P. The resist roller pair 208 restarts rotating to feed the recording sheet p into the transfer nip at a timing of being synchronized with arrival of the superimposed four color toner image transferred into the transfer nip.

The superimposed four color toner image closely attached to the recording sheet P at the transfer nip is transferred from the endless belt-type photoreceptor 49 to the recording sheet P all at once by the effects of nip pressure and the transfer electric fields. The superimposed four color toner image transferred onto the recording sheet P forms a full-color image in combination with white color of the recording sheet P. The recording sheet P on which the full-color image is thus formed is transferred from the transfer nip to the fixing device 76, and is then, after the full-color image being fixed, discharged outside the copier.

[Modification]

Figure 17:
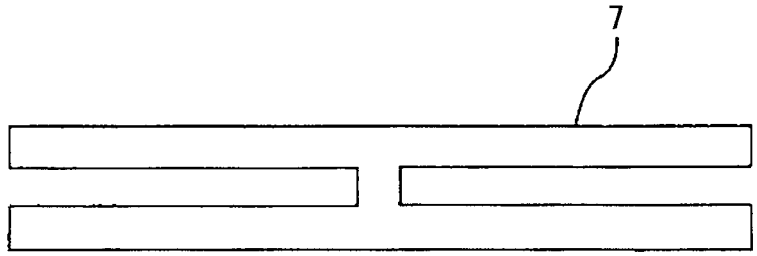
FIG. 17 is a longitudinal-sectional diagram illustrating a cylindrical base of a toner carrier roller provided in a copier according to modification.

FIG. 17 is a longitudinal-sectional diagram illustrating a cylindrical base 7 of the toner carrier roller 2 provided in a copier according to first modification. The cylindrical base 7 is made of insulating acrylic resin and includes a shaft through-hole inside the cylindrical base 7 such that shaft holes may be formed one at each end in an axial direction of the cylindrical base 7.

Figure 18:
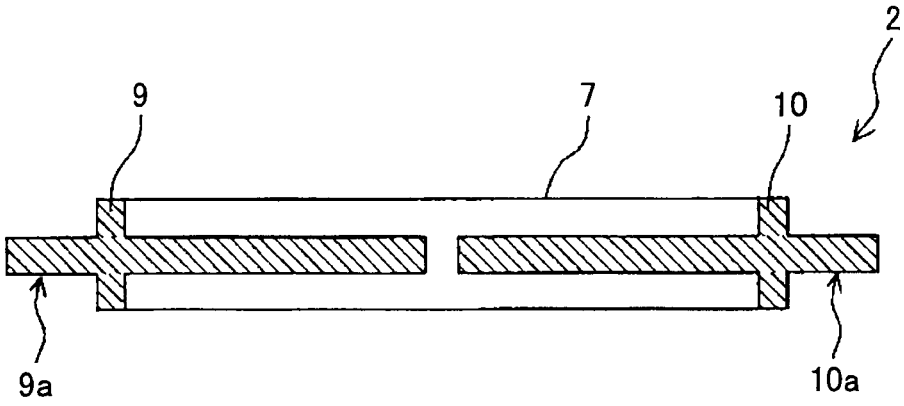
FIG. 18 is a longitudinal-sectional diagram illustrating the toner carrier roller provided in the copier according to modification.

FIG. 18 is a longitudinal-sectional diagram illustrating the toner carrier roller 2 provided in the copier according to the modification; A first flange 9 is press fit in the shaft hole formed at one end in the axial direction of a roller portion of the toner carrier roller 2. A second flange 10 is press fit in the shaft hole formed at the other end in the axial direction of the roller portion of the toner carrier roller 2.

Figure 19:
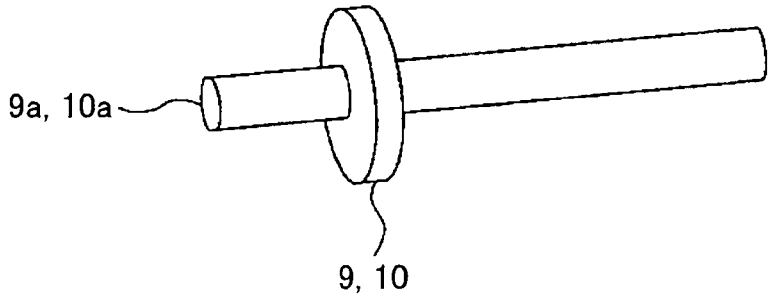
FIG. 19 is a perspective diagram illustrating a first flange and a second flange of the toner carrier roller.

FIG. 19 is a perspective diagram illustrating the first flange 9 or the second flange 10 provided in the toner carrier roller 2. The first flange 9 or the second flange 10 is made of metal such as stainless steel and includes a disc-like flange portion on its rod-like shaft at a predetermined position in the axial direction. The disc-like flange portion 9*a* has a diameter the same as that of the cylindrical base 7. The first flange 9 and second flange 10 are press fit into the respective shaft holes of the cylindrical base 7 and the respective flange portions of the first flange 9 and second flange 10 are pressure welded one at each end in the axial direction of the cylindrical base 7. The pressure welded flange portions are electrically conductive with the described first pulse electrodes.

Figure 20:
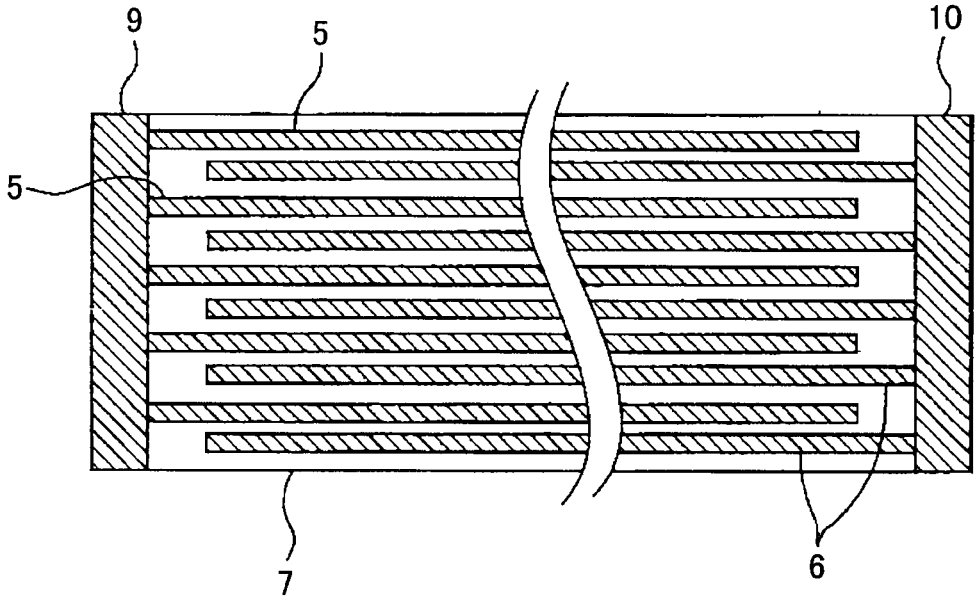
FIG. 20 is a front diagram illustrating a base of the toner carrier roller.
Figure 21:
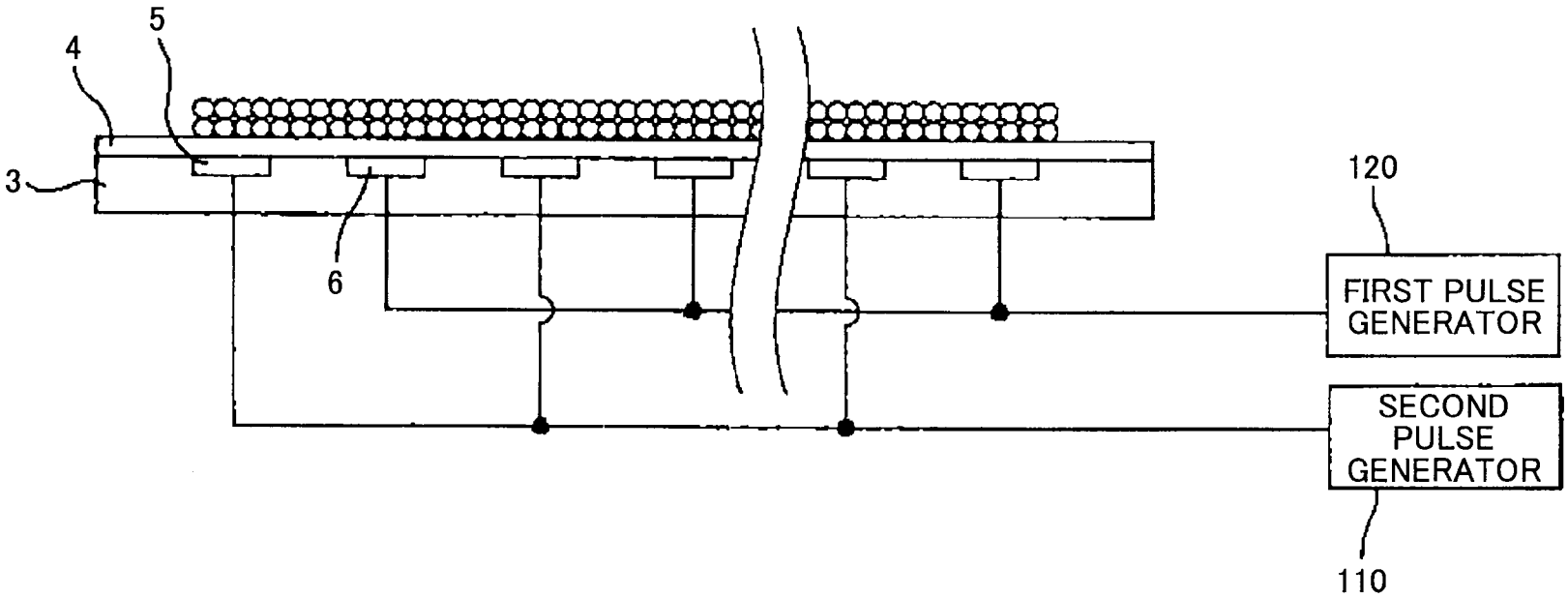
FIG. 21 is a cross-sectional diagram illustrating a base of the toner carrier roller.

As illustrated in FIG. 20, the cylindrical base 7 of the toner carrier roller 2 includes second pulse electrodes 5 extended in the axial direction and the first pulse electrodes 6 extended in the axial direction of the cylindrical base 7. The second pulse electrodes and the first pulse electrodes are alternately arranged at predetermined intervals in a roller circumferential direction of the cylindrical base 7. As illustrated in FIG. 21, the second pulse electrodes 5 and the first pulse electrodes are formed on a surface of an insulating base layer 3 of the cylindrical base 7. The second pulse electrodes 5 and the first pulse electrodes formed on the surface of an insulating base layer 3 are covered with an insulating surface layer 4.

Accordingly, a second periodic pulse voltage generated from a second pulse output unit 110 is applied to the second pulse electrodes 5 via the first flange 9. Further, a first periodic pulse voltage generated from a first pulse output unit 120 is applied to the first pulse electrodes 6 via the second flange 10. Thus, the toner on the toner carrier roller 2 (or cylindrical base 7) reciprocally moves between the first pulse electrodes 6 and the second pulse electrodes 5 while exhibiting a hopping behavior.

The above description has given an example of the toner carrier roller to which two types of electrodes are formed; namely, the first pulse electrodes to which the first periodic pulse voltage is applied and the second pulse electrodes to which the second periodic pulse voltage is applied. However, the toner carrier roller 2 may be provided with three or more types of electrodes to which the dedicated respective (e.g., first, second and third) periodic pulse voltages are applied.

In the copier according to an embodiment and modification, the first pulse output unit 120 is configured to carry out a duty ratio changing process to change the duty ratio of the first periodic pulse voltage based on the duty ratio adjusting signal transmitted from the controller 150. With such a configuration, the blade bias, which is composed of the DC voltage having the same polarity as that of the toner and is utilized for applying the voltage to the toner thickness regulator blade 22, may be changed by changing the duty ratio of the first periodic pulse voltage.

Further, in the copier according to an embodiment and modification, the controller 150 includes the temperature-humidity sensor 152 provided as an environment detector to detect the temperature and humidity inside the copier, such that the controller may carry out a duty ratio adjusting signal changing process based on the detected result by the temperature-humidity sensor. With such a configuration, the amount of change in the thickness of the toner layer caused by the change in the amount of toner charge may be offset by the change in the capability of regulating the toner layer thickness held by the toner layer thickness regulator blade 22. Accordingly, the thickness of the toner layer may be stabilized.

Moreover, in the copier according to an embodiment, the controller 150, the photoreceptor 49 and the developing device 1 may serve as a developing capability measuring unit configured to measure developing capability of the developing device 1 by carrying out a developing performance adjusting process. The controller 150 is configured to carry out a process of changing the central potential of the peak-to-peak voltage of the first periodic pulse voltage and the central potential of the peak-to-peak voltage of the second periodic pulse voltage based on the measured result of the developing capability (i.e., detected result of the image intensity of the standard toner image). With this configuration, the developing potential may be adjusted to achieve the target image intensity by changing the central potential of the peak-to-peak voltage of the first periodic pulse voltage and the central potential of the peak-to-peak voltage of the second periodic pulse voltage.

Further, in the copier according to an embodiment and modification, the pulsed power supply 100 is provided with the base voltage power supply 102 configured to output, as the base voltage, the DC voltage having the same value as the low potential peak value of the periodic pulse voltage, and the superimposing voltage power supply 103 is configured to output, as the superimposing voltage to be superimposed on the base voltage, the DC voltage having the same value as the peak-to-peak voltage of the periodic pulse voltage. Accordingly, in the copier according to an embodiment and modification, the first pulse output unit 120 and the second pulse output unit 110 are configured to carry out a process for periodically generating pulses by switching on or off of the application of the superimposing voltage generated from the superimposing voltage power supply 103 onto the base voltage. With this configuration, since the base voltage power supply 102 and the superimposing voltage power supply 103 are shared between the first pulse output unit 120 and the second pulse output unit 110, the cost reduction may be achieved.

Moreover, in the copier according to an embodiment and modification, since the central potential of the peak-to-peak voltage of the first periodic pulse voltage and the central potential of the peak-to-peak voltage of the second periodic pulse voltage may be changed based on the measured result of the developing capability (i.e., detected result of the image intensity of the standard toner image). With this configuration, the respective mean potentials of the first and the second periodic voltages may be simultaneously changed by changing the base voltage.

In the copier according to an embodiment and modification, the smoothing circuit makes the first periodic pulse voltage smooth, which is the negative mean voltage having the same polarity as the toner charge, to generate a smoothed first periodic pulse voltage as a negative DC voltage having the same polarity as the toner charge. The generated negative DC voltage having the same polarity as the toner charge is then applied to the toner layer thickness regulator member to regulate the toner layer in a predetermined thickness without separately having a specific DC power supply for applying the DC voltage to the toner layer thickness regulator member.

Embodiments of the present invention have been described heretofore for the purpose of illustration. The present invention is not limited to these embodiments, but various variations and modifications may be made without departing from the scope of the present invention. The present invention should not be interpreted as being limited to an embodiments that are described in the specification and illustrated in the drawings.

The present application is based on Japanese Priority Application No. 2010-202865 filed on Sep. 10, 2010, with the Japanese Patent Office, the entire contents of which are hereby incorporated by reference.

What is claimed is:

1. An image forming apparatus comprising:

an electrostatic latent image carrier configured to carry an electrostatic latent image thereon;

a developing device including a toner carrier formed of a base carrying toner on an endless surface thereof, first electrodes aligned along a surface direction of the base and to which a first periodic pulse voltage is periodically applied, and second electrodes aligned along the surface direction of the base and to which a second periodic pulse voltage having a phase differing from a phase of the first periodic pulse voltage is periodically applied, the developing device configured to develop the electrostatic latent image carried on the surface of the electrostatic latent image carrier by transferring the toner on the surface of the toner carrier to a developing region formed between the toner carrier and the electrostatic latent image carrier by surface movement of the toner carrier while causing the toner to hop between the first electrodes and the second electrodes on the surface of the toner carrier, and attaching the toner hopping therebetween to the electrostatic latent image carried on the surface of the electrostatic latent image carrier;

a pulsed power supply including a first pulse output unit configured to output the first periodic pulse voltage having a mean potential with a polarity the same as a polarity of a normal toner charge, and a second pulse output unit configured to output the second periodic pulse voltage;

a smoothing circuit configured to make the first periodic pulse voltage output from the first pulse output unit smooth to generate a smoothed first periodic pulse voltage as a direct voltage; and a toner layer thickness regulator member configured to regulate, on receiving the direct voltage generated from the smoothing circuit, a thickness of the toner layer on the surface of the toner carrier in a region between a toner supply position at which toner is supplied and the developing region formed between the toner carrier and the electrostatic latent image carrier before the toner layer on the surface of the toner carrier enters into the developing region.

2. The image forming apparatus as claimed in claim 1, further comprising:

a controller configured to generate a control signal to cause the first pulse output unit to change a duty ratio of the first periodic pulse voltage.

3. The image forming apparatus as claimed in claim 2, further comprising:

an environment detector configured to detect conditions of an environment inside the image forming apparatus, wherein the controller carries out a process of changing the generated control signal based on a detected result of the conditions of the environment inside the image forming apparatus.

4. The image forming apparatus as claimed in claim 1, further comprising:

a developing capability measuring unit configured to measure a developing capability of the developing device, wherein the controller carries out a process of changing a peak-to-peak central potential of the first periodic pulse voltage and a peak-to-peak central potential of the second periodic pulse voltage based on a measured result of the developing capability measured by the developing capability measuring unit.

5. The image forming apparatus as claimed in claim 4, wherein at least one of the pulsed power supply further includes a base voltage power supply configured to output a direct voltage having the same value as a low potential peak value of the first periodic pulse voltage and a direct voltage having the same value as a low potential peak value of the second periodic pulse voltage as respective base voltages and a superimposing voltage power supply configured to output a direct voltage having the same value as a peak-to-peak voltage of the first periodic pulse voltage and a direct voltage having the same value as the peak-to-peak voltage of the second periodic pulse voltage as respective superimposing voltages to be superimposed on the respective base voltages, and wherein the first pulse output unit and the second pulse output unit are configured to carry out a process for periodically generating pulses by switching on or off of the application of the superimposing voltage generated from the superimposing voltage power supply onto a corresponding one of the base voltages.

6. The image forming apparatus as claimed in claim 5, wherein the peak-to-peak central potential of the first periodic pulse voltage and the peak-to-peak central potential of the second periodic pulse voltage are changed by changing the corresponding one of the base voltages based on the measured result of the developing capability measured by the developing capability measuring unit.

7. The image forming apparatus as claimed in claim 1, wherein the pulsed power supply is configured to apply the first periodic pulse voltage to a toner supply unit.

8. A method for forming an image in an image forming apparatus having an electrostatic latent image carrier, a developing device having a toner carrier on which first electrodes and second electrodes are formed and a toner supply unit supplying toner to the surface of a toner carrier to form a toner layer thereon, a pulsed power supply having a first pulse output unit outputting a first periodic pulse voltage and a second pulse output unit outputting a second periodic pulse voltage, a toner layer thickness regulator member and a smoothing circuit, the method comprising:

carrying an electrostatic latent image;

developing the electrostatic latent image by transferring the toner carried on the surface of the toner carrier by surface movement of the toner carrier to a developing region formed between the toner carrier and the electrostatic latent image carrier while causing the toner on the surface of the toner carrier to hop between the first electrodes aligned along a surface direction of the toner carrier and to which the first periodic pulse voltage is periodically applied and the second electrodes aligned along the surface direction of the toner carrier and to which the second periodic pulse voltage having a phase differing from a phase of the first periodic pulse voltage is periodically applied, and attaching the toner hopping therebetween to the electrostatic latent image carried on the surface of the electrostatic latent image carrier;

outputting the first periodic pulse voltage having a mean potential with a polarity the same as a polarity of a normal toner charge;

making the first periodic pulse voltage smooth to generate a smoothed first periodic pulse voltage as a direct voltage and applying the generated direct voltage the toner layer thickness regulator member;

regulating, on the application of the generated direct voltage to the toner layer thickness regulator member, the thickness of the toner layer on the surface of the toner carrier in a region between a toner supply position at which the toner is supplied and the developing region formed between the toner carrier and the electrostatic latent image carrier before the toner layer on the surface of the toner carrier enters into the developing region.

9. The method as claimed in claim 8, further comprising:

generating a control signal to change a duty ratio of the first periodic pulse voltage.

10. The method as claimed in claim 9, further comprising:

detecting conditions of an environment inside the image forming apparatus to carry out a process of changing the generated control signal based on a detected result of the conditions of the environment inside the image forming apparatus.

11. The method as claimed in claim 8, further comprising:

measuring a developing capability of the developing device to carry out a process of changing a peak-to-peak central potential of the first periodic pulse voltage and a peak-to-peak central potential of the second periodic pulse voltage based on a measured result of the developing capability.

12. The method as claimed in claim 11, further comprising:

outputting a direct voltage having the same value as a low potential peak value of the first periodic pulse voltage and a direct voltage having the same value as a low potential peak value of the second periodic pulse voltage as respective base voltages, and outputting a direct voltage having the same value as a peak-to-peak voltage of the first periodic pulse voltage and a direct voltage having the same value as the peak-to-peak voltage of the second periodic pulse voltage as respective superimposing voltages to be superimposed on the respective base voltages, such that a process for periodically generating pulses is carried out by switching on or off of application of the superimposing voltages onto the base voltages.

13. The method as claimed in claim 12, wherein the peak-to-peak central potential of the first periodic pulse voltage and the peak-to-peak central potential of the second periodic pulse voltage are changed by changing the respective base voltages based on the measured results of the respective developing capabilities.

14. The method as claimed in claim 8, wherein the first periodic pulse voltage is applied to the toner supply unit.

15. An image forming apparatus comprising:

an electrostatic latent image carrying means for carrying an electrostatic latent image;

a developing means for developing the electrostatic latent image on the electrostatic latent image carrying means by transferring toner carried on a surface of a toner carrier by surface movement of the toner carrier to a developing region formed between the toner carrier and the electrostatic latent image carrying means while causing the toner on the surface of the toner carrier to hop between first electrodes aligned along a surface direction of the toner carrier and to which a first periodic pulse voltage is periodically applied and second electrodes aligned along the surface direction of the toner carrier and to which a second periodic pulse voltage having a phase differing from a phase of the first periodic pulse voltage is periodically applied, and attaching the toner hopping therebetween to the electrostatic latent image carried on the surface of the electrostatic latent image carrying means;

a pulsed power supplying means for outputting the first periodic pulse voltage having a mean potential with a polarity the same as a polarity of a normal toner charge and outputting the second periodic pulse voltage;

a smoothing means for making the first periodic pulse voltage smooth to generate a smoothed first periodic pulse voltage as a direct voltage; and a toner layer thickness regulating means for regulating, on receiving the applied direct voltage, the thickness of the toner layer on the surface of the toner carrier in a region between a toner supply position at which the toner is supplied and a developing region formed between the toner carrier and the electrostatic latent image carrying means before the toner layer on the surface of the toner carrier enters into the developing region.

* * * * *